US007614738B2

(12) United States Patent
Takeuchi

(10) Patent No.: US 7,614,738 B2
(45) Date of Patent: Nov. 10, 2009

(54) IMAGE RECORDING APPARATUS

(75) Inventor: Masaru Takeuchi, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 336 days.

(21) Appl. No.: 11/420,530

(22) Filed: May 26, 2006

(65) Prior Publication Data

US 2006/0268089 A1 Nov. 30, 2006

(30) Foreign Application Priority Data

May 27, 2005 (JP) ..... 2005-156140

(51) Int. Cl.
*B41J 2/01* (2006.01)

(52) U.S. Cl. ..... 347/104; 271/293

(58) Field of Classification Search ..... 347/101, 347/104; 271/293

See application file for complete search history.

(56) References Cited

U.S. PATENT DOCUMENTS 6,018,640 A 1/2000 Blackman et al.
6,975,814 B2 12/2005 Tsusaka et al.
2003/0063175 A1 * 4/2003 Nishikawa ..... 347/104
2006/0023050 A1 * 2/2006 Nishiberi et al. ..... 347/104

FOREIGN PATENT DOCUMENTS

JP 2004 102165 4/2004

* cited by examiner

*Primary Examiner*—Stephen D Meier
*Assistant Examiner*—Ly T Tran
(74) *Attorney, Agent, or Firm*—Baker Botts L.L.P.

(57) ABSTRACT

An image recording apparatus has a recording head, a transporting passage, a paper support section, a pair of discharge rollers and a reverse-transporting mechanism. The paper support includes a main supporting member and an auxiliary supporting member disposed on the upstream side of the main supporting member. An opening can be formed between the two supporting members. The pair of discharge rollers can be rotated reversely, and one of the supporting members can be inclined. This makes it possible to transport backward, through the opening to the reverse-transporting mechanism, a recording medium with an image recorded on one side of the medium. The reverse-transporting mechanism leads the medium to the transporting passage and transports it again toward the recording head. Having a small number of parts and a simple structure, the image recording apparatus enables double-sided image recording.

19 Claims, 19 Drawing Sheets

IMAGE RECORDING APPARATUS

CROSS REFERENCE TO RELATED APPLICATION

The present application claims priority from Japanese Patent Application No. 2005-156140, filed on May 27, 2005, the disclosure of which is incorporated herein by reference in its entirety.

FIELD OF THE INVENTION

The present invention relates to an image recording apparatus which can record images on both sides of a sheet of paper (a recording medium).

BACKGROUND OF THE INVENTION

In recent years, in order to save paper resources, image recording apparatus which can record images on both sides of a sheet of paper (a recording medium) have been used in increasing numbers of offices and homes.

An increasing number of image recording apparatuses of this kind are developed in various types. For example, U.S. Pat. No. 6,975,814 (Japanese Patent Laid-open Publication No. 2004-102165 (FIG. 2)) discloses an image recording apparatus of this kind. A feed cassette is set (arranged) in the bottom of the main case of this image recording apparatus, and an electrophotographic toner type image recording unit is arranged over the feed cassette in the main case. In this image recording apparatus, a sheet of paper is transported from the feed cassette through a U-shaped transporting (conveying) passage in an upward direction toward the recording unit, where an image is first recorded on one side of the sheet. Subsequently, the sheet is transported through a fixing device to a discharge passage, where the upstream end of the sheet is nipped by a pair of discharge rollers, which is arranged at the end of the discharge passage which is downstream in the transporting direction. The sheet is stopped once with its upstream end nipped. Subsequently, the sheet is turned from the discharge passage and transported backward toward a reverse transporting passage, which extends over the feed cassette. As a result, the sheet is returned in an upside-down state to the U-shaped transporting passage. This makes it possible to record an image on the still blank side of the sheet at the recording unit, which is downstream from the U-shaped transporting passage.

An ink jet printer provided with an ink jet image recording unit (an ink jet head) is known as another image recording apparatus which can record images on both sides of a recording medium. The ink jet printer prints images on both sides of a sheet of paper as follows. First, while a pair of feed rollers and a pair of discharge rollers are feeding the sheet downstream below the ink jet head, the head prints an image on one side of the sheet. Subsequently, a discharge roller of the pair of discharge rollers is rotated reversely to return the sheet upstream below (passing through a portion below) the ink jet head. The returned sheet is transported through a predetermined transporting passage to be turned upside down so that the blank (back) side of the sheet can face the ink jet head. Then, while the two roller pairs are feeding the turned sheet again downstream below (passing through the portion below) the ink jet head, the head prints an image on the back side of the sheet.

As is the case with the image recording apparatus disclosed in U.S. Pat. No. 6,975,814, the ink jet printer is provided with a reverse transporting unit which reverses the transporting direction at a position in a discharge transporting passage after an image is recorded on one side of a sheet of paper. This increases the number of parts of the image recording apparatus, complicates its structure greatly and makes the apparatus bulky. The image recording apparatus has a long reverse transporting passage. While a sheet of paper with an image recorded on its one side is transported through the reverse transporting passage, this side is in contact with a transporting roller etc. and may consequently be stained with ink. Each of the foregoing ink jet image recording apparatuses, which can record images on both sides of a sheet of paper, also has a transporting path for sheet reversal. This makes the image recording apparatuses large in size and complicated in structure.

SUMMARY OF THE INVENTION

The present invention has been made to solve the foregoing problems. A first object of the invention is to provide a small-sized image recording apparatus which has a small number of parts and a simple structure, and which can record images on both sides of a recording medium without staining the side of the medium on which an image has been recorded, A second object of the invention is to provide a novel image recording apparatus which can record images on both sides of a recording medium being transported through a short transporting passage in the image recording apparatus.

According to a first aspect of the present invention, there is provided an image recording apparatus, including:

- a recording head which records an image on a recording medium;
- a paper feeding section which feeds the recording medium in a forward transporting direction toward the recording head;
- a transporting passage in which the recording medium is transported in the forward transporting direction from the paper feeding section toward the recording head;
- a support section which is provided between the recording head and the paper feeding section and which supports the recording medium being transported, the support section having an opening formed therethrough which opens when the recording medium with an image recorded on one side thereof is transported in a backward transporting direction; and
- a reverse-transporting mechanism which is provided between the opening and the transporting passage and which transporting again, toward the recording head, the recording medium with the image recorded on the one side thereof.

In the image recording apparatus of the present invention, the section has an opening which is formed therethrough and which opens when a recording medium with an image recorded on its one side is transported backward. The reverse-transporting mechanism can lead (guide) the recording medium with an image recorded on One side thereof through the opening to the transporting passage. Accordingly, the reverse-transporting mechanism is very simple in structure and has a small number of parts, as compared with the conventional reverse-transporting mechanism for double-sided image recording. Also, the transporting passage is short.

The image recording apparatus of the present invention may further include a main case. The paper feeding section may includes: a feed cassette which is provided below the recording head and is capable of storing a plurality of sheets of the recording medium piled substantially horizontally therein; and a feeding unit which is provided over the feed cassette and which feeds the sheets of the recording medium piled in the feed cassette by separating the sheets one by one, The transporting passage may be a U-turn passage in which the recording medium is transported in an upward direction from the feed cassette such that the recording medium faces a bottom surface of the recording head.

In the image recording apparatus of the present invention, the support section may includes a supporting member which is provided between the recording head and the feed cassette to support the recording medium being transported; the opening may be formed by inclining the supporting member wholly downwardly so that an edge of the supporting member which is upstream in the forward transporting direction approaches an upper side of the feeding unit; and the recording medium with the image recorded on the one side thereof may be transported in the backward transporting direction toward the reverse-transporting mechanism by reversely rotating a pair of discharge rollers arranged on a downstream side of the supporting member in the forward transporting direction. Thus, a recording medium with an image recorded on its one side can be transported backward to the reverse-transporting mechanism by reversely rotating the pair of discharge rollers arranged (supported) in the vicinity of the recording head and on a downstream side in the forward transporting direction. This shortens the backward transporting path extremely in comparison with the conventional case where a backward transporting means is arranged in the vicinity of a discharge section. The shortened path enables double-sided image recording at high speed.

In the image recording apparatus of the present invention, the support section may include a supporting member which is provided between the recording head and the feed cassette to support the recording medium being transported; and the supporting member may includes a downstream member and an upstream member, the downstream member being disposed on a downstream side of the upstream member in the forward transporting direction. In this case, at least one of the downstream and upstream members may be inclined to form the opening through the supporting member; and the recording medium with the image recorded on the one side thereof may be transported in the backward transporting direction toward the reverse-transporting mechanism by reversely rotating a pair of discharge rollers arranged on a downstream side of the downstream member in the forward transporting direction. This reduces the size of the supporting member which can be inclined. This also saves the motive power of an actuator for inclining the supporting member. This further reduces the range within which the supporting member can be inclined. The reduced range results in the whole image recording apparatus being small and thin.

In the image recording apparatus of the present invention, when the image has been recorded on the one side of the recording medium by the recording head and then image-recording is performed for the other side of the recording medium, the supporting member may be wholly inclined, or a part of the supporting member along the forward transporting direction may be inclined, downwardly to transport the recording medium in the backward transporting direction after once stopping the recording medium in a state that an upstream end of the recording medium in the forward transporting direction is nipped by the pair of discharge rollers, so that the recording medium is guided to the reverse-transporting mechanism arranged over the feeding unit. This makes it possible to very easily separate (discriminate) one-sided image recording and double-sided image recording from each other only by controlling the pair of discharge rollers regarding the direction in which a recording medium is transported.

In the image recording apparatus of the present invention, the feeding unit may include an arm capable of pivoting upward and downward and of placing at least a portion of the recording medium thereon, and a reversible feed roller supported rotatably by a free end of the arm; and the reverse-transporting mechanism may include the arm, the feed roller and a driven rotor which is disposed above the feed roller and is capable of coming into contact with a cylindrical surface of the feed roller. Accordingly, during double-sided image recording, or when another recording medium is fed from the feed cassette, the feed roller does not stain the side (surface) of the recording medium on which the image has been recorded. The reverse-transporting mechanism uses the feeding unit and additionally includes the driven rotor. This greatly reduces the manufacturing cost of the reverse-transporting mechanism and makes the reserve transporting mechanism compact so as to make the image recording apparatus small in size.

In the image recording apparatus of the present invention, when a downstream end in the backward transporting direction of the recording medium nipped by the pair of discharge rollers reaches at a nipping position at which the downstream end is nipped by the feed roller and the driven rotor, the pair of discharge rollers may release the recording medium. In this case, when a recording medium with an image recorded on its one side is transported backward, the resistance to it is low, and this side of the medium is not damaged.

In the image recording apparatus of the present invention, the recording head may be an ink jet recording head which jets ink droplets selectively toward the recording medium on the support section. While the support section functions to control (regulate) the gap between the recording medium on the support section and the recording head, the support section serves as a member through which an opening is formed, and which leads backward, to the reverse-transporting mechanism, a recording medium with an image recorded on its one side. Consequently, the support section contributes toward reducing the number of parts and making the image recording apparatus compact.

According to a second aspect of the present invention, there is provided an image recording apparatus, including:

- a recording head which records an image on a recording medium;
- a paper feeding section including a feed roller which feeds the recording medium in a forward transporting direction to the recording head by making contact with the recording medium;
- a transporting passage formed from the paper feeding section toward the recording head;
- a pair of discharge rollers which nip the recording medium and which rotates in one direction to discharge the recording medium with an image recorded on one side of the recording medium by the recording head, and which rotates in a reverse direction to the one direction for double-sided recording on the recording medium; and
- a driven roller which nips, together with the feed roller, the recording medium transported by the rotation of the pair of discharge rollers in the reverse direction to feed the nipped recording medium to the transporting passage.

According to the image recording apparatus of the second aspect of the present invention, the feed roller transports a recording medium from the paper feeding section to the transporting passage. For double-sided recording, this feed roller cooperates with the driven roller to transport, to the transporting passage, a recording medium transported backward by the pair of discharge rollers after an image is recorded on one side of the recording medium. Thus, because the feed roller has a transporting function for double-sided recording, it is possible to simplify the structure of the image recording apparatus and shorten the transporting passage in comparison with the conventional image recording apparatuses.

In the image recording apparatus of the present invention, the feed roller may come into contact with the recording medium at a first contact point of the feed roller when the feed roller feeds the recording medium from the paper feeding section, and the feed roller may come into contact with the recording medium at a second contact point of the feed roller when the feed roller feeds, together with the driven roller, the recording medium to the transporting passage after the image is recorded on the one side of the recording medium. This makes it possible to effectively use the feed roller. In this case, the feed roller may rotate in the one direction when feeding the recording medium from the paper feeding section; and the feed roller may rotate in the reverse direction to the one direction when the feed roller feeds the recording medium together with the driven roller.

The image recording apparatus of the present invention may further include a support section which supports the recording medium being transported in the vicinity of the recording head, and the support section may have an opening formed therein, the recording medium with the image recorded on the one side thereof passing through the opening. The pair of discharge rollers can transport the recording medium through the opening toward the feed roller.

The support section may include a movable part and a fixed part, and the movable part may move relative to the fixed part to form the opening. The opening may be opened by the movable part when double-sided recording is performed. The image recording apparatus of the present invention may further include a control unit which controls the pair of discharge rollers such that the pair of discharge rollers rotate in the reverse direction when the double-sided recording is performed.

BRIEF DESCRIPTION OF THE DRAWINGS

Embodiments of the present invention will be described below in detail with reference to the accompanying drawings, in which:

FIG. 11 shows the carriage positioned in the maintenance section of the image recording apparatus;

FIG. 12 shows the carriage positioned in the maintenance section;

FIG. 13 shows the spur holder turned upward by the moving carriage;

FIG. 14 shows the spur holder turned upward;

DETAILED DESCRIPTION OF PREFERRED EMBODIMENTS

Figure 1:
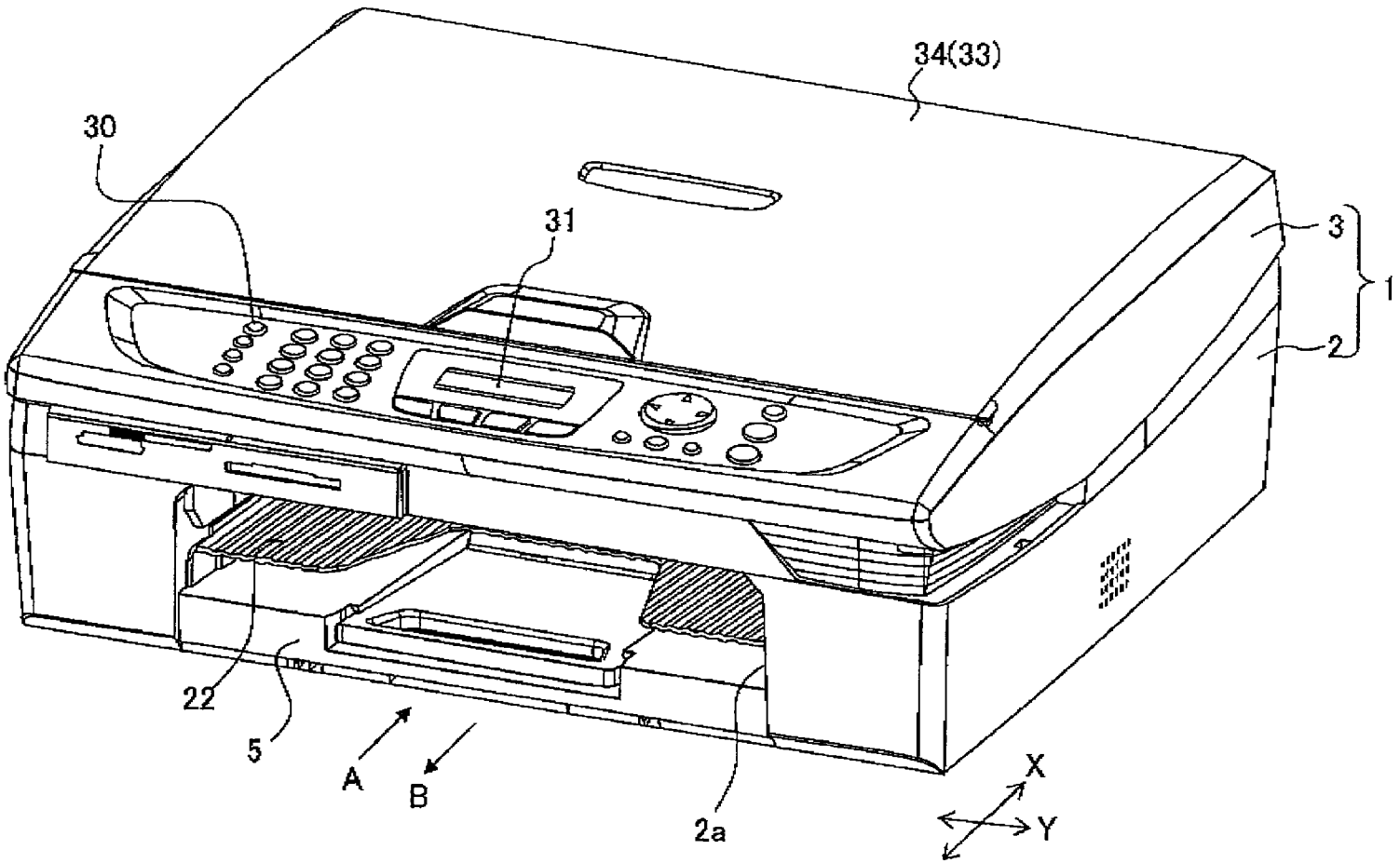
FIG. 1 is a perspective view of a multi-function image recording apparatus as an embodiment of the invention.

With reference to FIG. 1, a multi-function image recording apparatus 1 as an embodiment of the present invention has taxing, printing, copying and scanning functions. The image recording apparatus 1 has a main case 2 and an upper case 3. The main case 2 substantially takes the form of a box open at its top. The upper case 3 is hinged or otherwise supported on one side (the left side along the Y-axis in FIG. 1) of the main case 2 so as to pivot up and down on a pivoting axis (not shown). In the following description, the left and right direction (primary scanning direction, Y-axis direction), the forward and backward direction (secondary scanning direction, X-axis direction) and the vertical direction will be based on the directions with respect to the image recording apparatus 1 as shown in FIG. 1. The cases 2 and 3 are injection moldings of synthetic resin.

The upper case 3 is fitted with an operation panel 30 on a front portion of its top. The operation panel 30 is fitted with numeric buttons, a start button, function buttons and other buttons, which an operator can press for various operations of the image recording apparatus 1. The operation panel 30 is also fitted with a display 31 such as liquid crystal display (LOD), which indicates the setting of the image recording apparatus 1, an operation message or the like as the need arises.

The upper case 3 is fitted with a scanner (an image reading section) 33 in the rear side of the operation panel 30. When the image recording apparatus 1 performs the faxing function, the scanner 33 reads the image on a paper (document) to be faxed to a target (recipient) fax machine. When the image recording apparatus 1 performs the copying function, the scanner 33 reads the image on a paper to be copied. The scanner 33 is constructed of a flat-bed reading section and a pivotable cover 34. The flat-bet reading section has a large-sized glass plate and reads the image on a paper placed on the plate. The pivotable cover 34 covers the top of the flat-bed reading section and is hinged on the rear of the image recording apparatus 1, to be rotatable in open/close manner about the hinge.

Thus, the upper case 3 can be opened greatly upward around the left end of the image recording apparatus 1 in FIG. 1 with respect to the main case 2. The image recording apparatus 1 is provided with an open-posture maintaining mechanism for maintaining the open posture of the upper case 3. A guide rail (not shown) is fixed to the under side of the upper case 3 and positioned near its one side (near the back side of the image recording apparatus 1). The guide rail has a guide slot extending in the direction in which the image sensor moves. The guide slot has a notch (not shown) oriented upward and formed at its end away from the pivoting axis. One end (base end) of a supporting rod (not shown) is supported pivotably on the side of the main case 2 which is away from the pivoting axis. The tree end (tip end) of the supporting rod is fitted with a guide pin, which engages movably with the guide rail. The upper case 3 can be held at a preset wide angle to the main case 2, with the notch engaging with the guide pin.

A line type contact image sensor (CIS) (not shown) is provided directly below the glass plate of the flat-bed reading section. The image sensor is an example of photoelectric conversion element for reading the image on a paper placed directly on the glass plate. The image sensor is provided reciprocatably along a guide rod (not shown) extending in a moving direction of a carriage 13 (the primary scanning direction, the Y-axis direction). The carriage 13 will be explained later on.

Next, the structure of a printer (a recording section) will be described below. As shown in FIG. 1, a feed cassette 5 is arranged on the central portion, of the main case 2, in the left and right direction. In the paper cassette 5, sheets of paper P as recording media can be piled substantially horizontally on the bottom of the cassette 5. The main case 2 has an opening 2*a* formed through its front surface, through which the feed cassette 5 can be inserted into and removed from the case 2.

As shown in FIGS. 6, 7A, 7B and 8A to 8C, the main case 2 houses a feeding unit 6, a transporting path and a recording unit 10. The feeding unit 6 includes a feed roller 7 arranged over the feed cassette 5. The transporting path includes a U-turn transporting passage 9, for the feeding in the upward direction, in a rear end portion of the main case 2. A sheet of paper P can be transported in a substantially horizontal position in a forward transporting direction through the transporting path. A support section (paper support section) 11 in the form of a flat plate (see FIGS. 2 and 3) is arranged in the transporting path. The recording unit 10 includes an ink jet recording head 12 (see FIGS. 15A to 15C and 16A to 16D), which ejects ink onto the sheet P on the paper support section 11 to record an image on the sheet. As will be stated later on in detail, an opening 50 (see FIGS. 8B and 15B) can be formed through the paper support section 11. A sheet of paper P with an image recorded on its one side can be transported through the opening 50 backward to a reverse-transporting mechanism 48, which uses the feeding unit 6. Afterwards, the backward transported sheet P is returned in an upside-down state (reversed state) through the U-turn transporting passage 9 to the recording unit 10, where an image can be recorded on the other side of the sheet.

Figure 2:
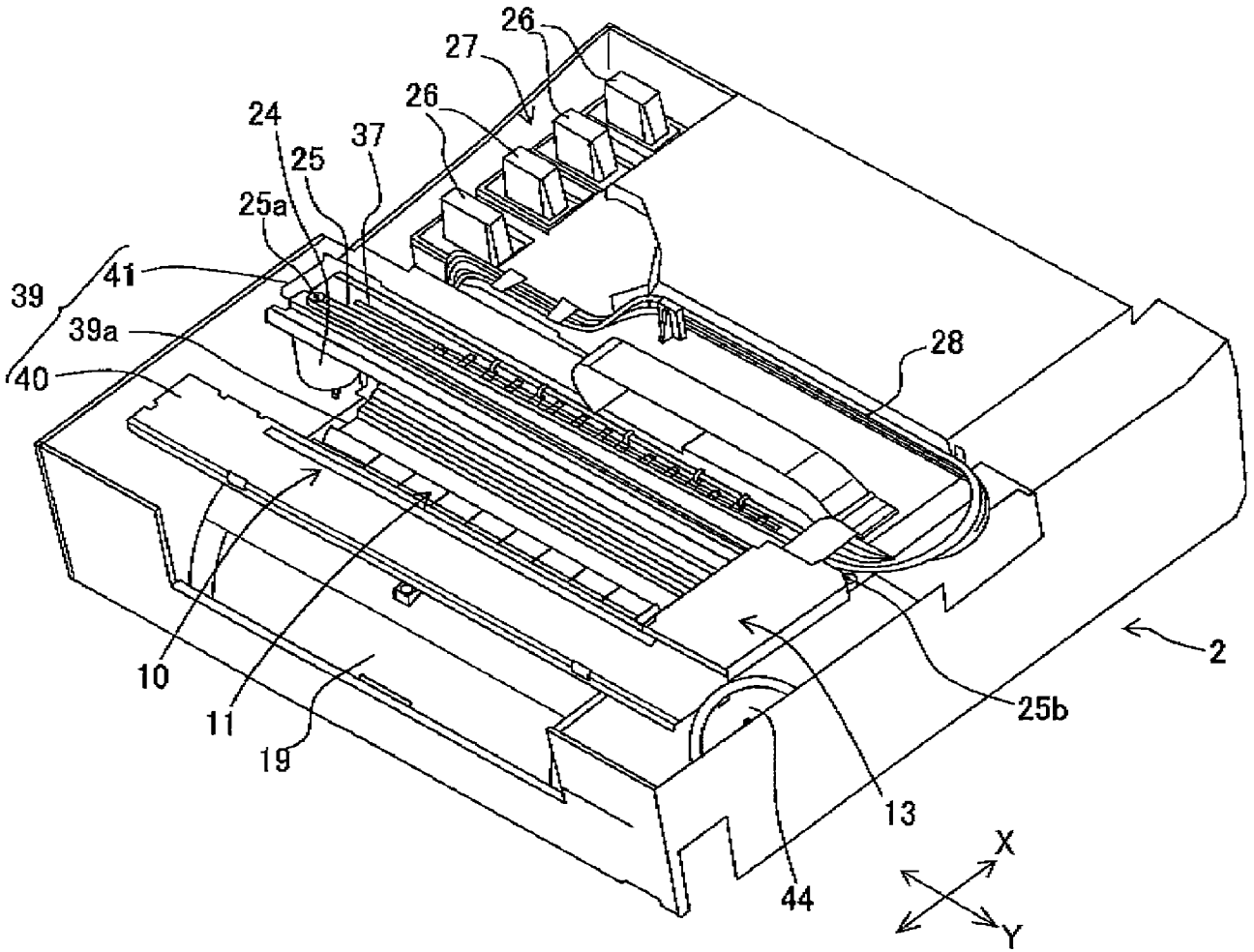
FIG. 2 is a perspective view of the image recording apparatus from which its upper case is removed, with the main case viewed from the rear side.

With reference to FIG. 2, the main case 2 has an accommodation section 27 formed in it. The accommodation section 27 is positioned near the inner side of the side plate which faces and is the farthest from the side plate on which the upper case 3 pivots. Ink cartridges 26 can be set downward in the accommodation section 27 and supply ink to the recording head 12 for color recording. Each ink cartridge 26 stores an ink of a different color. In this embodiment, tour ink cartridges 26 store black (B), cyan (C), magenta (M) and yellow (Y) inks. Of course, an image recording apparatus using not less than four inks should be able to accommodate ink cartridges equal in number to that of the inks. Inks are supplied from the ink cartridges 26 to the recording head 12 through flexible ink tubes 28 (FIG. 2).

Figure 3:
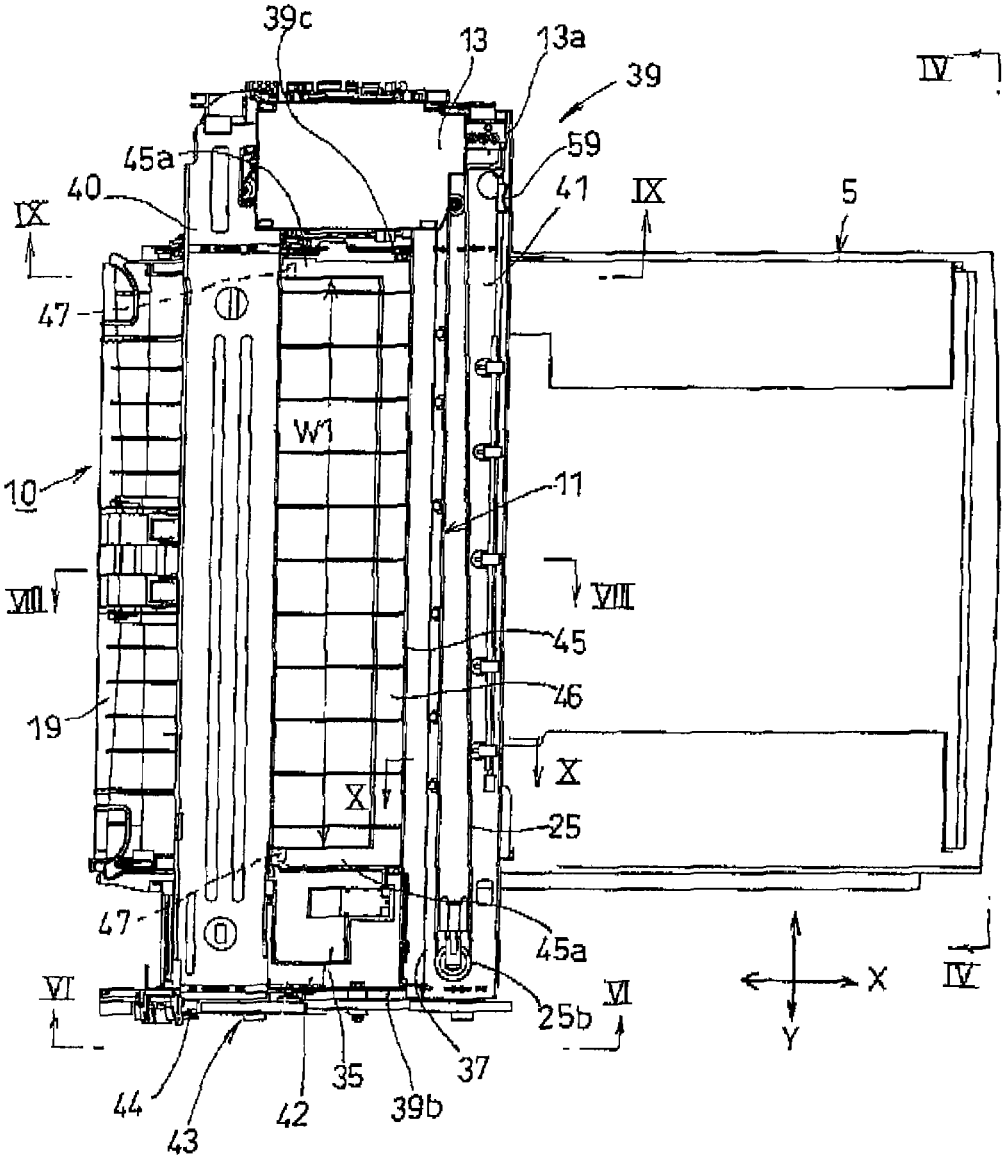
FIG. 3 is a plan view of the recording unit of the image recording apparatus into which a feed cassette is inserted.
Figure 4:
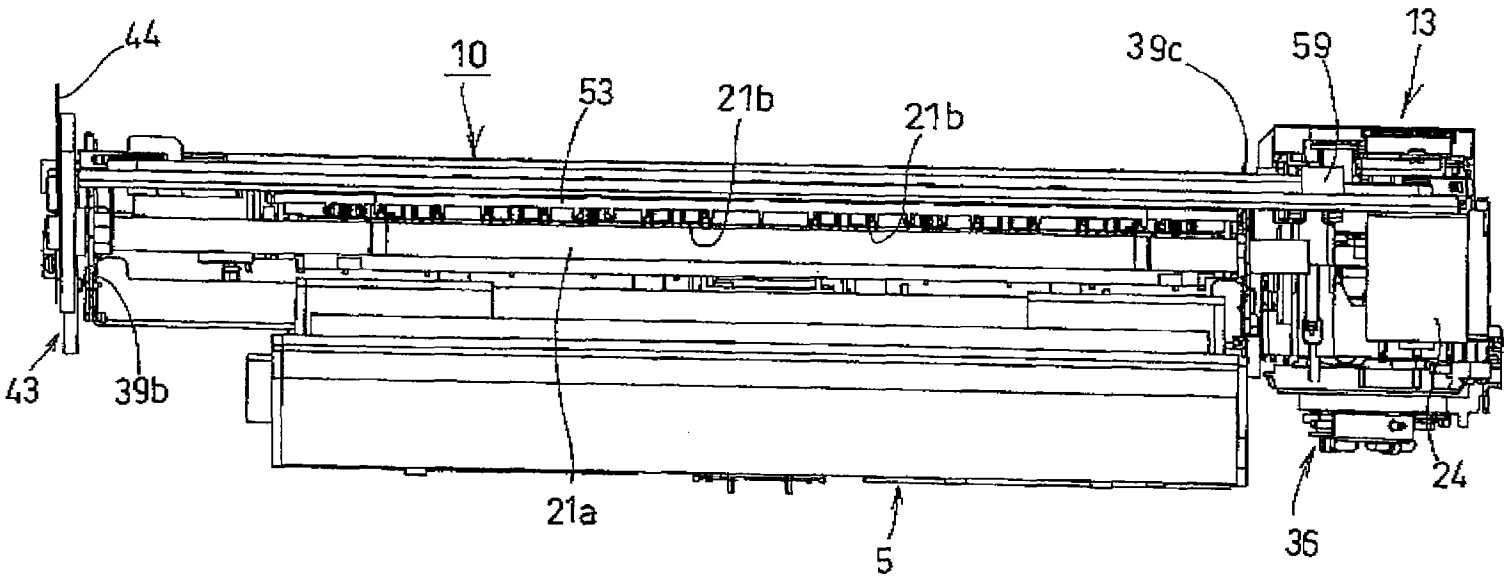
FIG. 4 is a view taken along line IV-IV in FIG. 3.
Figure 5:
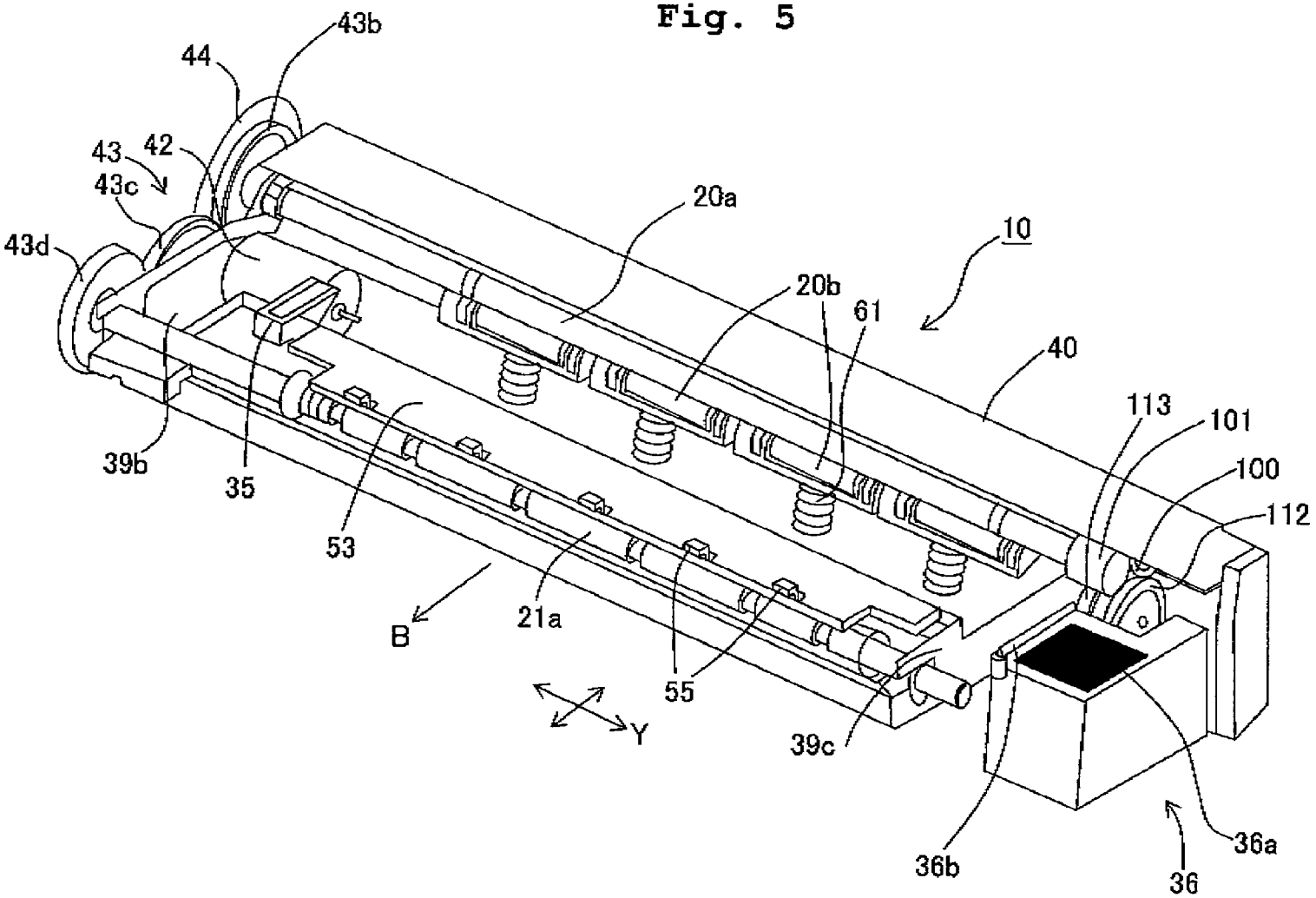
FIG. 5 is a perspective view of the recording unit from which its downstream guide plate and its supporting members are removed.
Figures 7A, 7B:
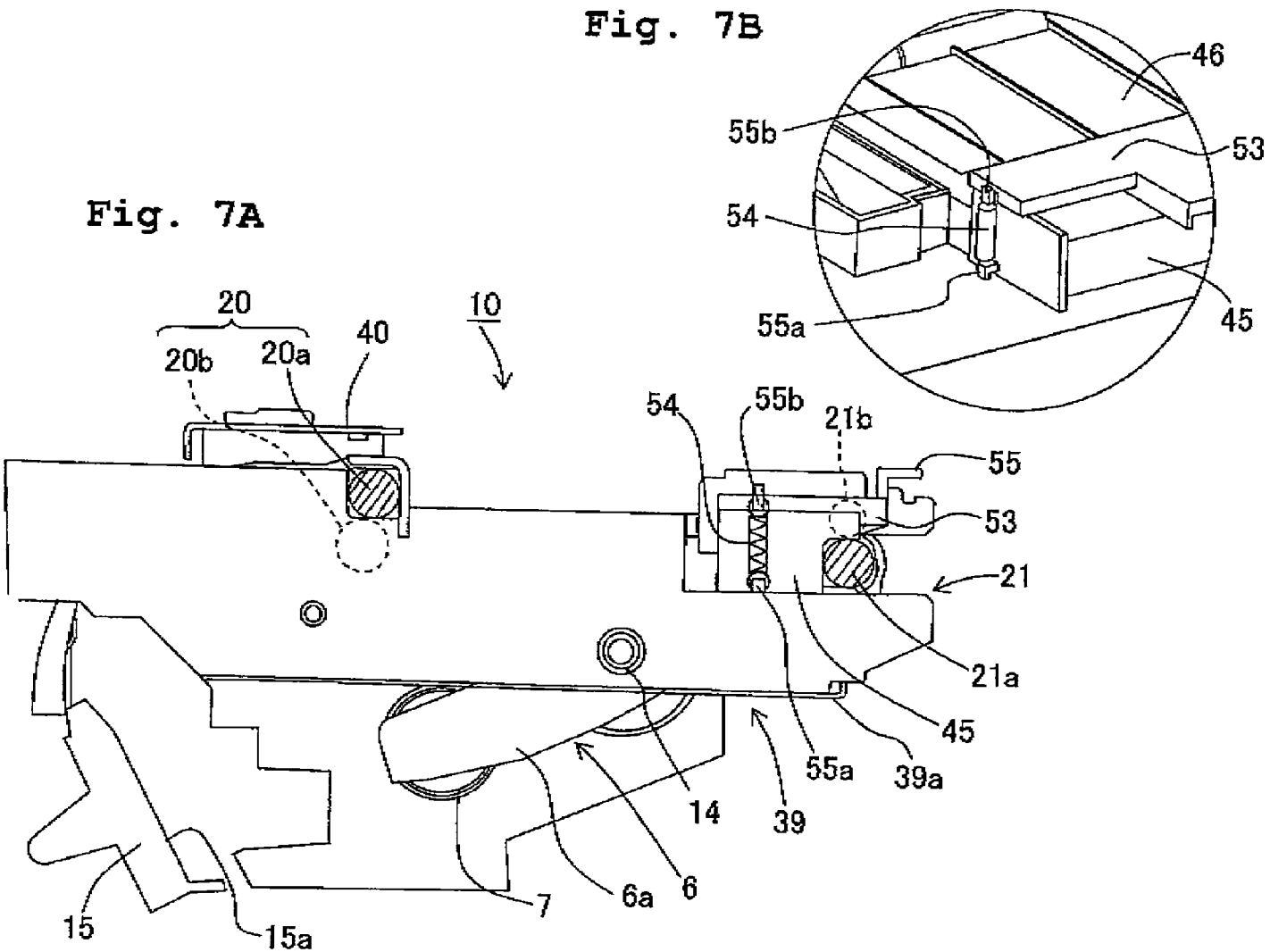
FIG. 7A is a partial a side view showing the structure of the recording unit in the main case 2 of the image recording apparatus.
FIG. 7B is a partial perspective view showing the biasing and pivotal axis of the spur holder of the image recording apparatus.

As shown in FIGS. 2 to 5, the recording unit 10 mainly constructed of the carriage 13, the paper support section 11 in the form of a plate and made of synthetic resin, a CR (carriage) motor 24, a timing belt 25 and an engine frame 39 made of a metal plate. The carriage 13 carries the recording head 12 (see FIGS. 15A to 16D). The timing belt 25 is connected to the CR motor 24 which reciprocates the carriage 13. The engine frame 39 supports the carriage 13, paper support section 11 and CR motor 24. The engine frame 39 is positioned over the feed cassette 5 in a rear portion of the main case 2. As shown in FIGS. 3 to 5, the engine frame 39 includes a frame body 39*a* in the form of a box and a pair of guide plates 40 and 41 which extend over the frame body 39*a* in the left and right direction of the main case 2 (in the primary scanning direction, the Y-axis direction). The carriage 13 is supported slidably by the guide plates 40 and 41. As shown in FIG. 7A, a driving shaft 14 is supported rotatably by the frame body 39*a*. As shown in FIG. 7A, the feeding unit 6 includes an arm 6*a* of the driving shaft and feeding unit 6, the arm 6*a* being supported pivotably by the frame body 39*a*. The paper support section 11 in the form of a flat plate is arranged in the frame body 39*a* and supports a sheet of paper P under the recording head 12. A biasing member such as a torsion spring (not shown) biases the arm 6*a* upward around the axis on which the arm is supported.

A resist roller (transporting roller) pair 20, is arranged at an upstream side in the forward transporting direction, with the paper support section 11 intervened between the pair, and transports a sheet of paper P to a position under the recording head 12. The resist roller pair 20 is constructed of a driving transporting roller 20*a* and driven transporting rollers 20*b*, which are positioned under the driving roller 20*a*. A discharge roller pair 21 is arranged on a downstream side of the paper support section 11 and transports, to a discharge section 22, a sheet of paper P with an image or images recorded on it. The discharge roller pair 21 is constructed of a driving discharge roller 21*a* and spurs 21*b*, which are positioned over the discharge roller 21*a*. The engine frame 39 includes a pair of side plates 39*b* and 39*c*, which have roller support sections. Both ends of the transporting roller 20*a* and discharge roller 21*a* are supported rotatably by the roller support sections of the side plates 39*b* and 39*c*. The sheet P being transported is nipped between the transporting rollers 20*a* and 20*b*. A sheet of paper P being discharged is nipped between the discharge roller 21*a* and spurs 21*b*.

Figure 6:
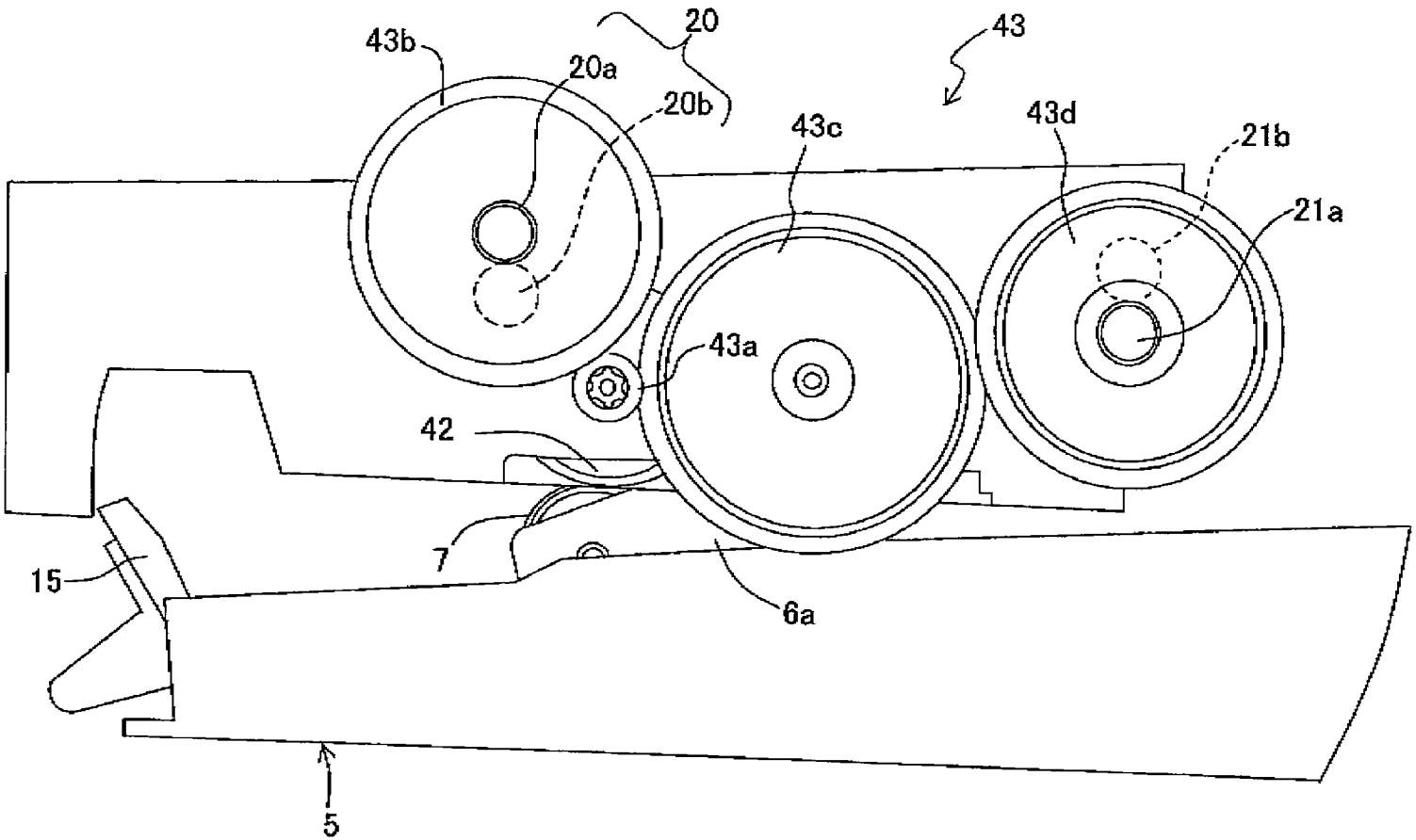
FIG. 6 is a side view taken along line VI-VI in FIG. 3.

With reference to FIGS. 3, 5 and 6, a LF (line feed) motor 42 which is reversibly rotatable is arranged near the side plate 39*b* which is opposite to a maintenance section 36. The driving force from the LF motor 42 is transmitted to the transporting roller 20*a*, discharge roller 21*a* and maintenance section 36 via a predetermined gear transmission mechanism 43. As shown in FIG. 6, the gear transmission mechanism 43 is constructed of a pinion 43*a*, a driving gear 43*b*, an intermediate gear 43*c* and a driving gear 43*d*. The pinion 43*a* is fixed to the driving shaft of the LF motor 42 and positioned between the driving gear 43*b* and intermediate gear 43*c*, and engages with these gears 43*a*, 43*b*. The intermediate gear 43*c* engages with the driving gear 43*d*. The driving gear 43*b* is fixed to one end (the left end) of the transporting roller 20*a* of the resist roller pair 20. The other driving gear 43*d* is fixed to one end (the left end) of the discharge roller 21*a* of the discharge roller pair 21.

In this embodiment, the torque (rotational force) of the LF motor 42 is transmitted from the other end of the transporting roller 20*a* to the feeding unit 6 via a transmission switching section for the maintenance section 36, which will be described later on.

As stated already, the transporting roller 20*a* and discharge roller 21*a* are positioned over and under the transporting path respectively. Accordingly, the rotation of the LF motor 42 in a predetermined direction results in these rollers 20*a* and 21*a* rotating in mutually opposite directions.

A portion of the gear transmission mechanism 43 is provided with a rotary encoder 44 for detecting the feed amount of the sheet P transported by the transporting roller 20*a*. The CR motor 24 and LF motor 42 are constructed to be rotatable both in positive (normal) and reverse directions.

When sheets of paper P is fed from the feed cassette 5 by separating the sheets one by one, the LF motor 42 rotates reversely to rotate the driving shaft 14 of the feeding unit 6 in counterclockwise direction in FIG. 7A. The rotation of the driving shaft 14 in this direction results in the arm 6*a* pivoting downward against the bias force. This brings the feed roller 7 into contact with the surface of an uppermost sheet P of the sheets P piled in the feed cassette 5, at a first contact point 7*a* on the lower side of the feed roller 7, while this roller 7 rotates in the feeding direction (clockwise direction in FIG. 7A).

When no sheet of paper P is separated and fed from the feed cassette 5, the LF motor 42 rotates in the normal direction to rotate the driving shaft 14 clockwise in FIG. 7A. The rotation of the driving shaft 14 in this direction results in the arm 6*a* pivoting upward. This brings the feed roller 7 out of contact with the uppermost sheet P in the feed cassette 5, with this roller 7 rotated in the direction (counterclockwise in FIG. 7A) opposite to the feeding direction by the gear transmission provided to the arm 6*a*.

With reference to FIG. 3, an ink reservoir 35 is arranged outside of one side of the sheet P being transported. In this embodiment, the ink reservoir 35 is positioned near the side plate 39*b* (on the left side with respect to the feeding direction) in the frame body 39*a* of the engine frame 39. The maintenance section 36 is arranged outside of the other side of the sheet P being transported. In this embodiment, the maintenance section 36 is positioned near the side plate 39*c* (on the right side in FIG. 3). The ink reservoir 35 has a flushing position formed in it, where the recording head 12 ejects ink periodically during the recording operation of the image recording apparatus 1 to prevent its nozzles from clogging up. The recording head 12 receives ink at the ink reservoir 35. When the recording head 12 is positioned at the maintenance section 36, the carriage 13 is in its waiting position. With reference to FIG. 5, the maintenance section 36 has a cap 36*a*, which can cover a nozzle surface (lower surface) of the recording head 12 for recovery processing etc. The recovery processing includes sucking different inks selectively through the nozzles of the recording head 12 and removing air bubbles out of a buffer tank (not shown) over the head 12. With reference to FIG. 5, when the carriage 13 moves horizontally from the maintenance section 36 toward an image-recording area, a wiper blade 36*b* wipes the nozzle surface of the recording head 12 to perform cleaning therefor.

Figure 12:
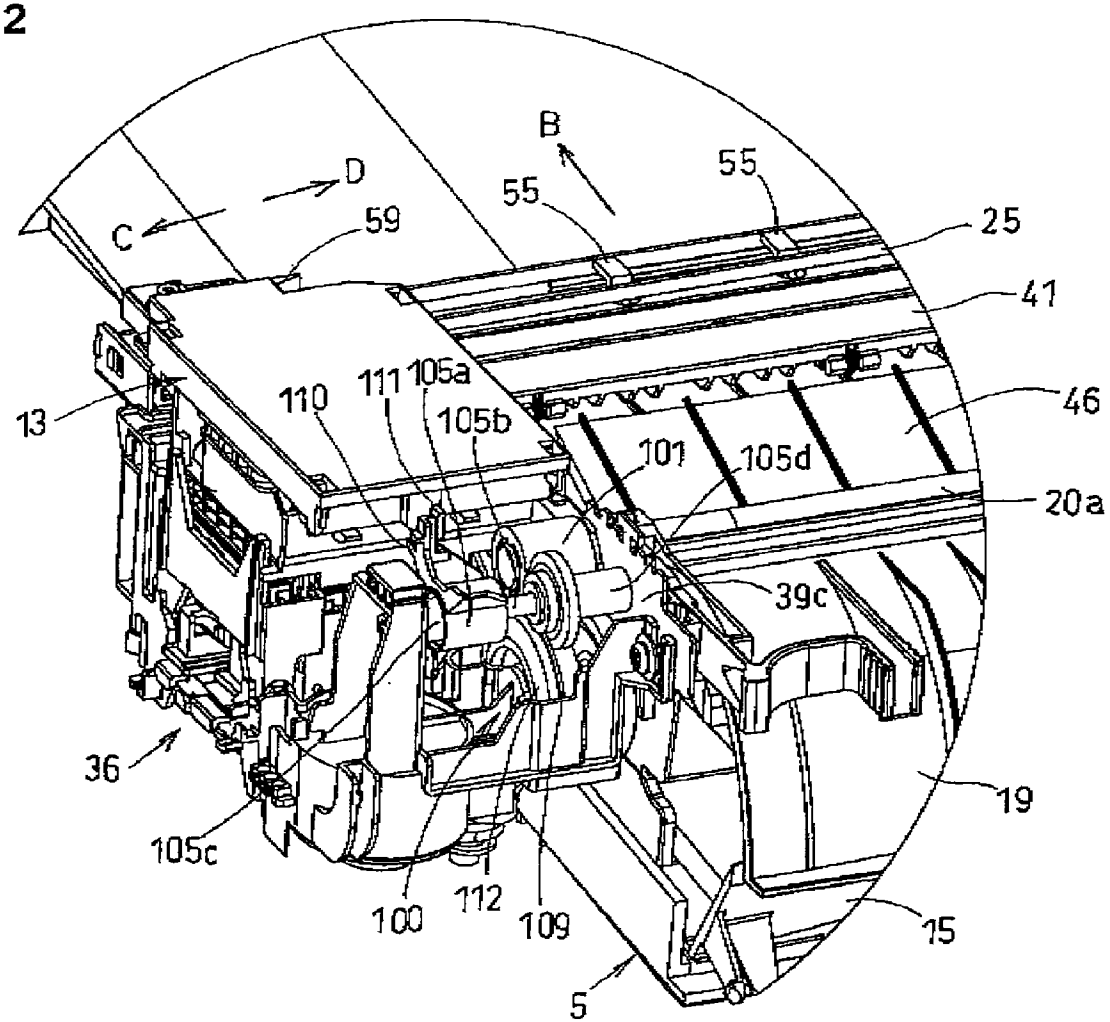
FIG. 12 is a perspective view from the side, of the image recording apparatus, which is upstream in the forward transporting direction.

As appreciated from FIG. 3, the guide plate 41 is positioned downstream in the paper feeding direction (direction indicated by an arrow A). As seen from FIG. 3, the timing belt 25 extends in the primary scanning directions (along the Y axis) over the guide plate 41 to reciprocate the carriage 13 which carries the recording head 12. With reference to FIG. 2, the timing belt 25 is wound around pulleys 25*a* and 25*b*. With reference to FIGS. 2 and 12, the CR (carriage) motor 24 (a DC motor in this embodiment) drives the timing belt 25 and is fixed to the lower surface of the guide plate 41. The guide plate 41 is provided with a linear encoder (an encoder strip) 37 extending in the longitudinal direction of the guide plate 41 (in the primary scanning direction). The linear encoder 37 detects the position of the carriage 13 along the Y axis (in the primary scanning direction). The linear encoder 37 takes the form of a band and is positioned such that its inspection surface is along the vertical direction, the inspection surface having slits formed therein at regular intervals along the Y axis.

The structure of the paper support section 11 will be described below. The paper support section 11 supports a sheet of paper P in a state that the paper support section 11 is near to the lower surface of the carriage 13 (the nozzles). In order to transport backward a sheet of paper P with an image recorded on its one side, the paper support section 11 has an opening 50 to lead the sheet downwardly. FIGS. 3, 8A to 8C, 9A, 12 and 14 show the first embodiment of the present invention. The paper support section 11 of this embodiment is constructed of a main supporting member 45 and an auxiliary supporting member 46 in the form of flat plates which adjoin each other. The main supporting member 45 is downstream of the auxiliary supporting member 46 in the discharging direction (direction indicated by an arrow B). With reference to FIG. 3, the main supporting member 45 includes a main portion extending in a width direction perpendicular to the forward transporting direction of the sheet P, and both end portions 45*a* in the primary scanning direction (direction of Y axis) extending upstream in the forward transporting direction of the sheet P from both ends of the main portion. Each of the both end portions 45*b* has an L-shaped in a plan view. With reference to FIG. 3, the auxiliary supporting member 46 is fitted between the end portions 45*a*. The auxiliary supporting member 46 is rectangular in plan view and has a width W1, which is greater than the maximum width of sheets of paper P to be transported.

Figure 8A:
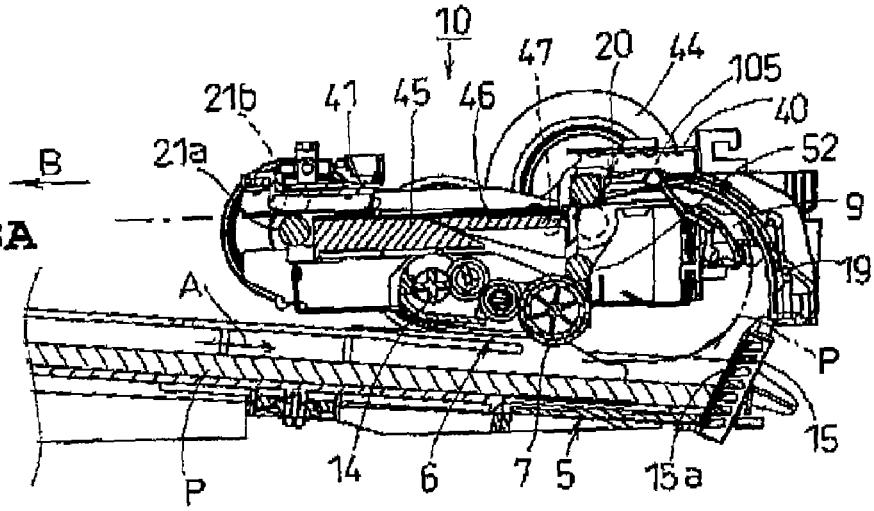
FIGS. 8A to 8C are sectional views taken along line VIII-VIII in FIG. 3, showing the operation of the image recording apparatus.
Figure 8B:
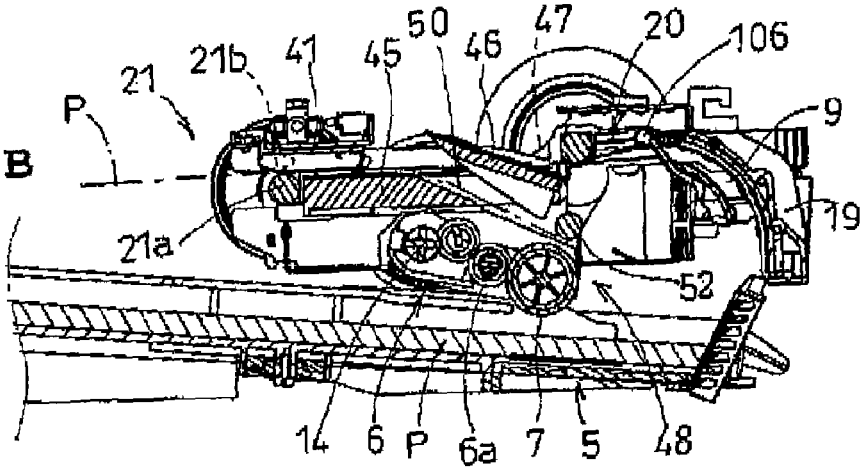
Figure 8C:
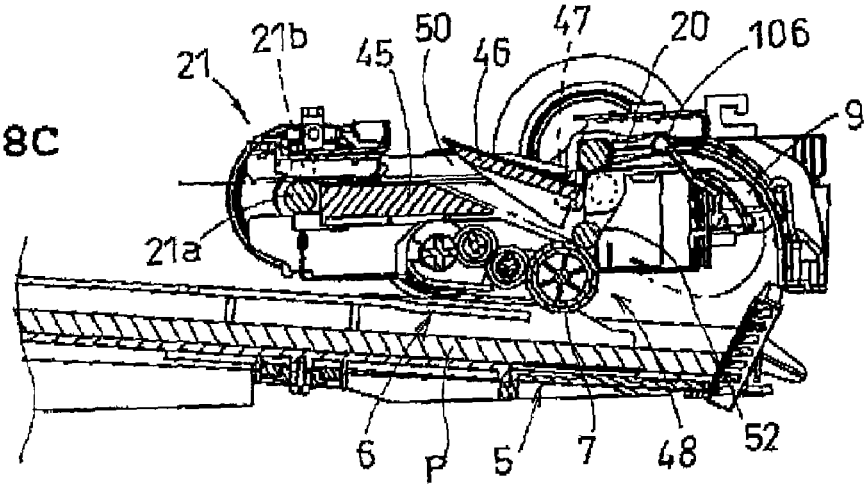

The main supporting member 45 is fixed to the frame body 39*a* of the engine frame 39. The wider surface of the main supporting member 45 is parallel with the nozzle surface of the recording head 12. As shown in FIGS. 8A to 8C, the main portion of the main supporting member 45 includes a portion upstream in the forward transporting direction, the surface (upper surface) of which is inclined downwardly toward the upstream side in the forward transporting direction.

Figure 9B:
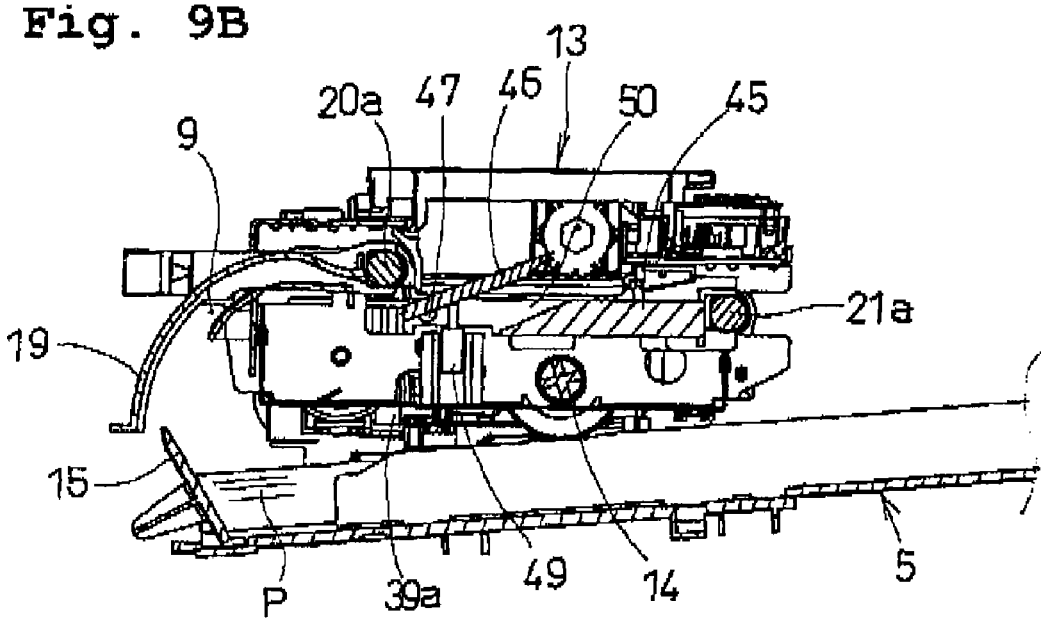
FIGS. 9A and 9B are sectional views taken along line IX-IX in FIG. 3, showing the operation of the image recording apparatus.
Figure 9A:
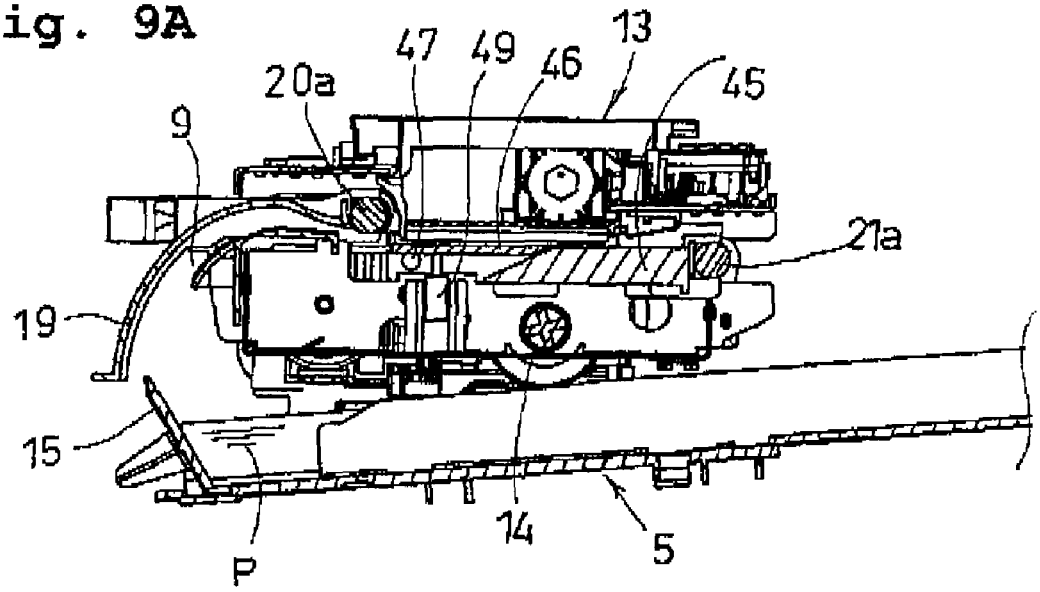

With reference to FIGS. 3, 8A to 8C, 9A and 9B, the auxiliary supporting member 46 extends along the Y axis. Both ends of the edge of the auxiliary supporting member 46 which is upstream in the forward transporting direction are supported by a pair of pivot pins 47 so that this supporting member 46 can pivot up and down on the pins 47. As shown in FIGS. 8A to 8C, the auxiliary supporting member 46 includes a portion downstream in the forward transporting direction, a surface (lower surface) of which is inclined upwardly toward the downstream side in the forward transporting direction. With this construction, when an opening solenoid 49, which will be described later on, is switched ON, it causes the auxiliary supporting member 46 to pivot, turning its downstream portion upward away from the main supporting member 45, so that the opening 50 is formed between the two supporting members 46 and 45 (FIGS. 8B, 8C, 9B, 12 and 14). When the opening solenoid 49 is switched OFF, the auxiliary supporting member 46 pivots downward so that the upper surfaces of the two supporting members 46 and 45 can be substantially flush with each other, closing the opening 50 (FIGS. 8A and 9A).

With reference to FIGS. 8A to 8C, the reverse-transporting mechanism 48 for returning, to the U-turn transporting passage 9, a sheet of paper P with an image recorded on its one side uses the feeding unit 6, and is constructed of the arm 6*a*, the feed roller 7 and a driven rotor 52, The arm 6*a* can pivot up and down. The feed roller 7 is supported rotatably by the tip end of the arm 6*a*. The driven rotor 52 is supported rotatably above the axis of the feed roller 7 and can move into and out of contact with the cylindrical surface of the feed roller 7. The rotation of the feed roller 7 in normal and reverse directions brings the driven rotor 52 into compressive contact with the cylindrical surface of the feed roller 7 or out of contact with the cylindrical surface so as to form a gap. In a state that the opening 50 is formed above the arm 6*a*, it is constructed such that the reverse rotation of the discharge roller pair 21 transports a sheet of paper P with an image recorded on its one side backwardly toward the reverse-transporting mechanism 48.

Figure 10A:
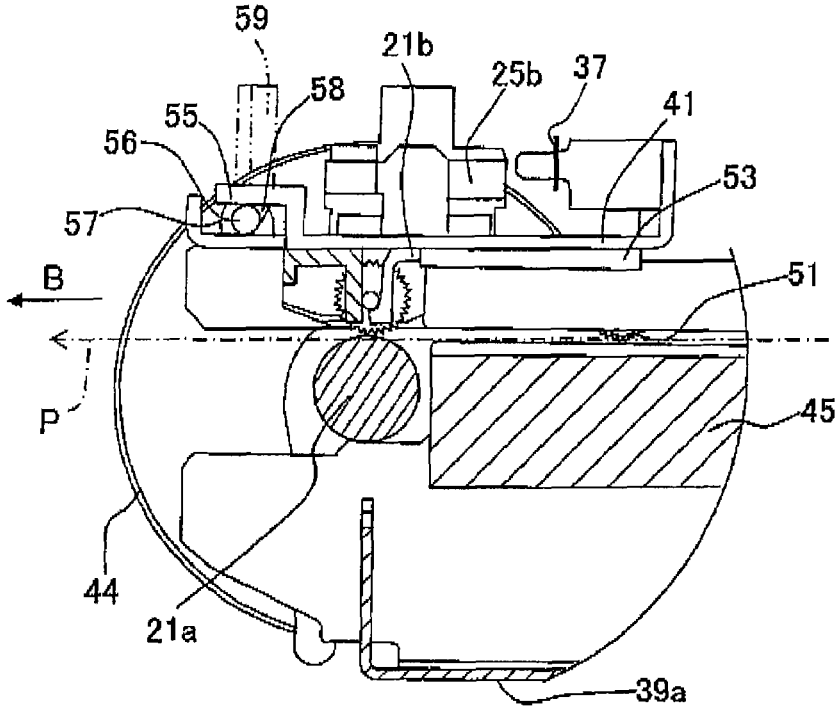
FIGS. 10A and 10B are sectional views taken along line X-X in FIG. 3, showing the operation of the image recording apparatus.
Figure 10B:
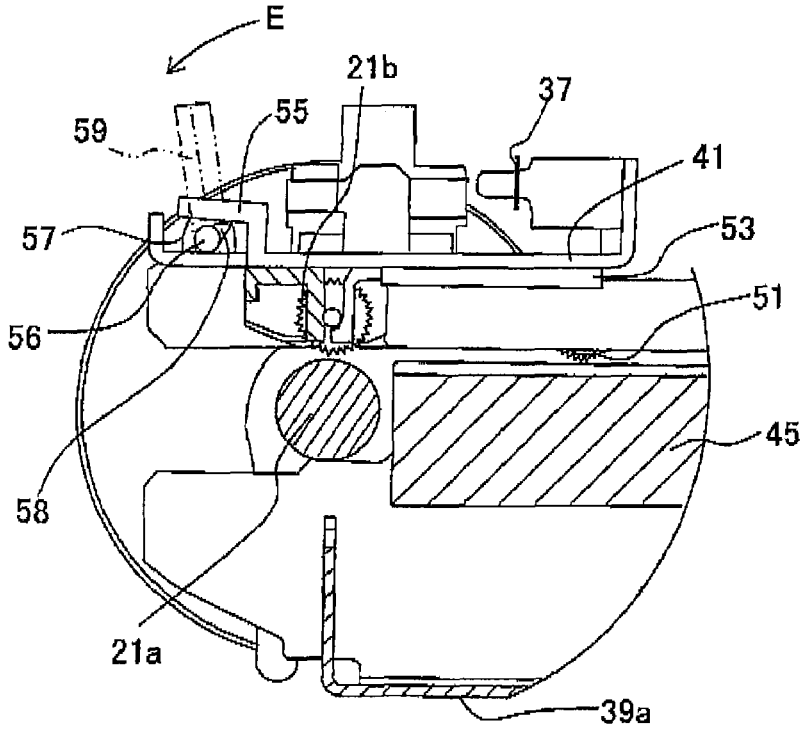

As shown in FIGS. 9A and 9B, the opening (electromagnetic) solenoid 49 is an actuator for causing the auxiliary supporting member 46 to pivot upward. The opening solenoid 49 has a rod, which can protrude upward to raise the auxiliary supporting member 46. The opening solenoid 49 is arranged at one end (not shown) in the longitudinal direction of the auxiliary supporting member 46. With reference to FIGS. 10A and 10B, spurs 51 are arranged at positions near to the upper surface of the main supporting member 45. The spurs 51 are downstream of the image-recording area, where the recording head 12 ejects ink from its nozzles, and are positioned between the image-recording area and the discharge roller pair 21. The spurs 51 prevent a sheet of paper P with an image recorded on its one side from floating into contact with the nozzle surface of the recording head 12. This keeps the image from being stained with ink, thereby preventing the degradation of printing quality.

With reference to FIGS. 7A, 7B, 10A and 10B, an explanation will be given below about how the spurs 21*b* of the discharge roller pair 21 can be brought into and out of contact with the discharge roller 21*a* which drives the spurs. The discharge roller 21*a* is supported at a fixed height by the frame body 39*a* of the engine frame 39. A spur holder 53 can move vertically over the discharge roller 21*a* and near the lower surface of the downstream guide plate 41. The spur holder 53 is made of synthetic resin and takes the form of a flat plate. The spur holder 53 extends along the Y axis and supports the spurs 21*b* at intervals along the discharge roller 21*a*. With reference to FIGS. 7A and 7B, the spur holder 53 has a pair of hooks 55*a* formed on both its ends. Likewise, the main supporting member 45, which is fixed to the frame body 39*a*, has a pair of hooks 55*b* formed on both its ends. A coil spring 54 connects the hook 55*a* on each end of the spur holder 53 and the hook 55*b* on the adjacent end of the main supporting member 45. The coil springs 54 at both ends of the spur holder 53 and main supporting member 45 bias the holder 53 downward to keep the teeth of the spurs 21*b* close to or in contact with the cylindrical surface of the driving discharge roller 21*a*.

Figure 11:
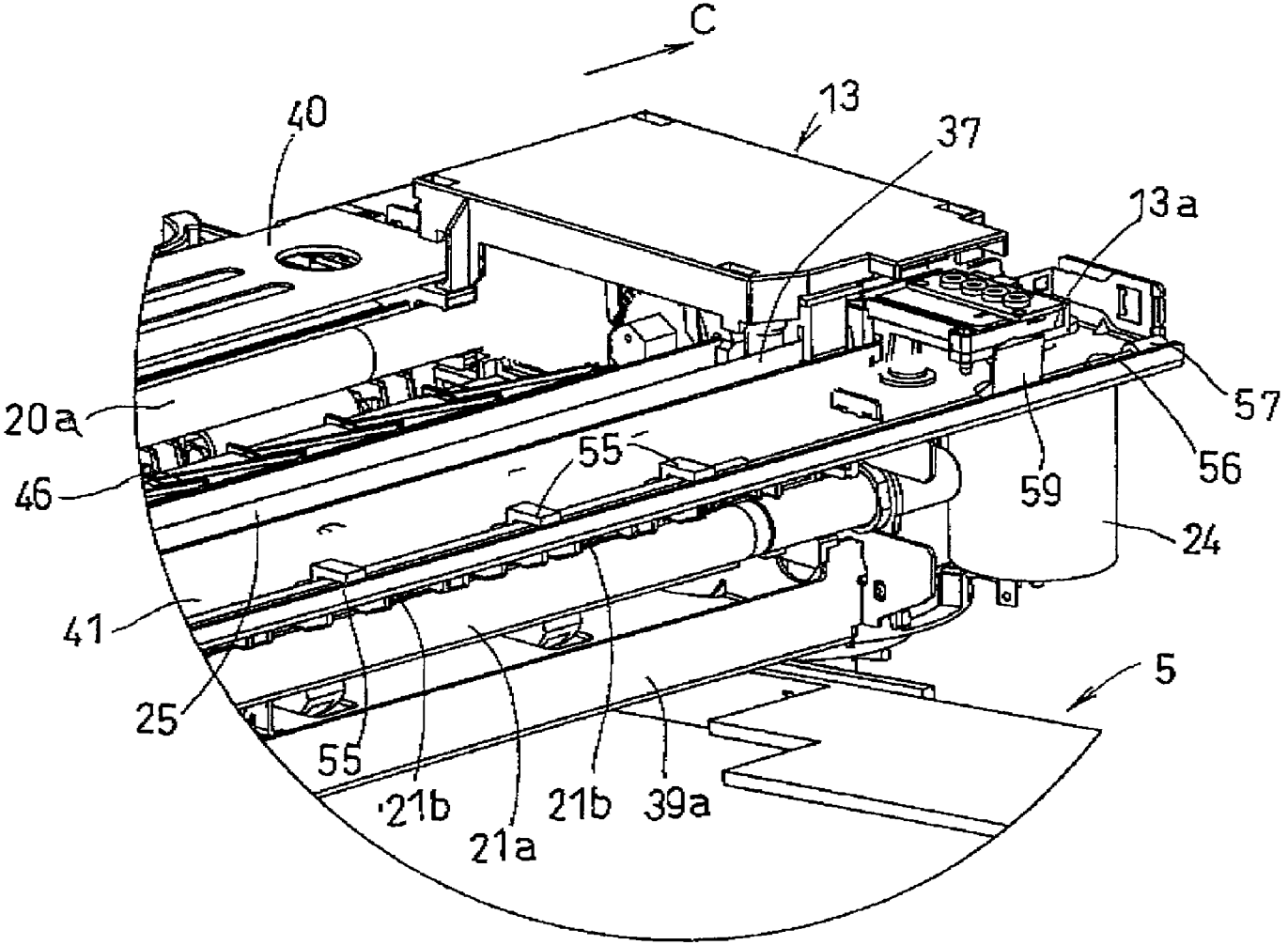
FIG. 11 is a perspective view from the side of the image recording apparatus on which the pair of discharge rollers extends.
Figure 13:
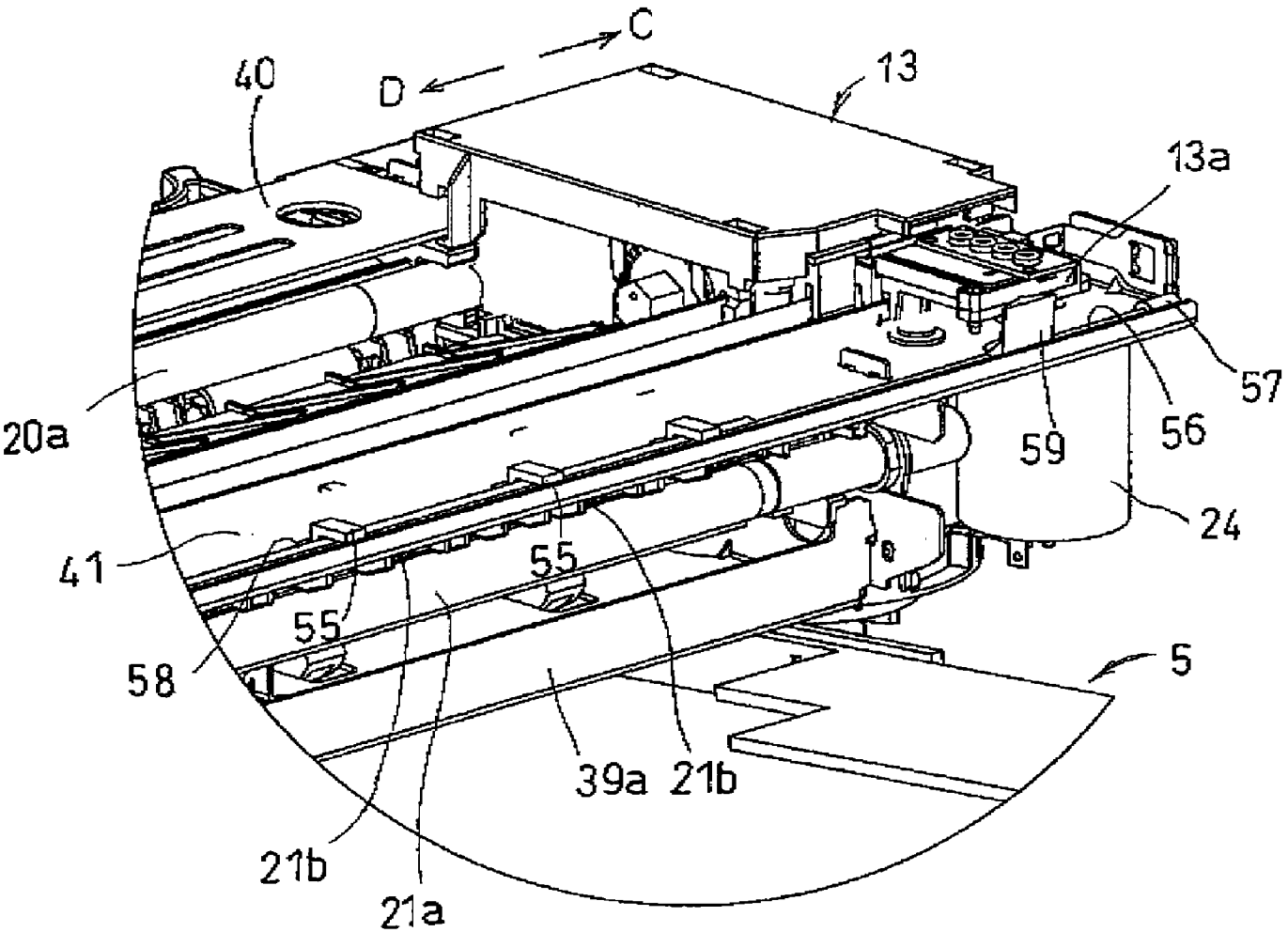
FIG. 13 is a perspective view from the side of the image recording apparatus on which the pair of discharge rollers extends.

With reference to FIGS. 7A, 10A, 10B, 11 and 13, the spur holder 53 has L-shaped contactors 55 formed at intervals along the Y axis integrally on the edge of its upper surface that is downstream in the forward transporting direction. The contactors 55 are arranged to face the upper surface of the downstream guide plate 41. With reference to FIGS. 10A, 10B, 11 and 13, the guide plate 41 has bearings 57 fixed to its upper surface and positioned near its edge downstream in the forward transporting direction. An operating shaft 56 is supported rotatably by the bearings 57 and extends along the Y axis. The operating shaft 56 has lifters 58 in the form of drops formed integrally with it. With reference to FIGS. 10A, 10B, 11 and 13, the operating shaft 56 also has a contact lever 59 fixed to it, which extends upward near the maintenance section 36. The contact lever 59 has a cross section of isosceles triangle in a plan view, and protrudes on the upstream side in the forward transporting direction. With reference to FIGS. 11 and 13, when the carriage 13 moves in the primary scanning direction (along the Y axis) from the image-recording area into the maintenance section, and when the carriage 13 moves in the direction indicated by arrow D from the maintenance section into the image-recording area, the back end surface (the back contact portion) 13*a* of the carriage 13 pushes the contact lever 59 to turn the operating shaft 56 counterclockwise in FIG. 10B. This causes the lifters 58 to lift the contactors 55, turning the spur holder 53 clockwise in FIG. 10B against the bias force of the coil springs 54 to lift the spurs 21*b* away from the cylindrical surface of the discharge roller 21*a*, as shown in FIG. 10B.

Figure 14:
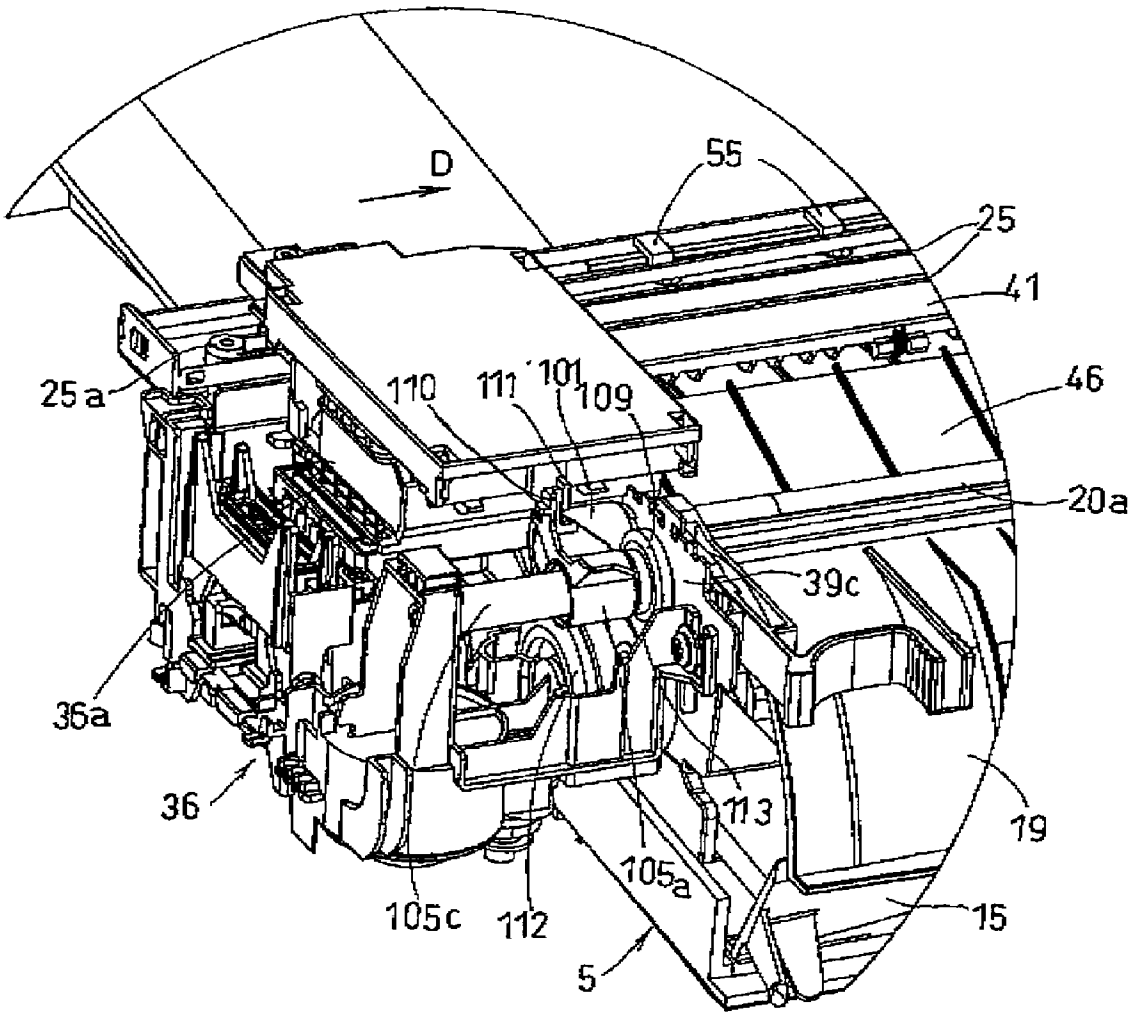
FIG. 14 is a perspective view from the side, of the image recording apparatus, which is upstream in the forward transporting direction.

With reference to FIGS. 12 and 14, an explanation will be given below about the structure of the transmission and the transmission switching mechanism 100 for the driving forces for the feeding unit 6 and maintenance section 36. As shown in FIG. 6 and as explained above, the torque of the reversible LF motor 42 is transmitted to the pinion 43*a* of the gear transmission mechanism 43 and the reduction gear 43*b*, which is fixed to the driving roller 20*a* of the resist roller pair 20. In the meantime, this torque is transmitted from the pinion 43*a* via the intermediate gear 43*b* to the gear 43*c* fixed to the discharge roller 21*a* of the discharge roller pair 21. Accordingly, the transporting roller 20*a* and discharge roller 21*a* rotate at the same time.

The transporting roller 20*a* has a driving gear 101 fixed to its right end (the maintenance section 36). The transmission switching mechanism 100 includes a switching gear 109 as an intermediate gear, which is in mesh with the driving gear 101, and which can slide in parallel with the axis line of transporting roller 20*a*. The transmission switching mechanism 100 is constructed to transmit driving force selectively to the first transmission section for the feeding unit 6 and the second transmission section for the maintenance section 36.

As shown in FIGS. 12 and 14, the transmission switching mechanism 100 is constructed of a block section 105*a*, a supporting shaft 105*b*, the switching gear 109, a contactor 110, a first bias spring 105*c* and a second bias spring 105*d*. The block section 105*a* can slide in parallel with the axis line of the transporting roller 20*a*. The switching gear 109 can be disconnected from the block section 105*a* and slide along the supporting shaft 105*b*. The contactor 110 protrudes upward from and integrally with the block section 105*a*. The first bias spring 105*c* biases the block section 105*a* toward the outer surface of the side plate 39*c*. The second bias spring 105*d* is arranged between the outer surface of the side plate 39*c* and the switching gear 109 to bias this gear toward one side of the block section 105*a*. The first bias spring 105*c* is greater in bias force than the second bias spring 105*d*.

The carriage 13 has a pushing section 111 fixed to it. With reference to FIG. 12, when the carriage 13 moves in the direction indicated by arrow C in the maintenance section 36, the pushing section 111 pushes the contactor 110 in this direction to move the block section 105*a* away from the switching gear 109 against the bias force of the first bias spring 105*c*. This brings the switching gear 109 into engagement with a maintenance gear 112, so that driving force is transmitted to the maintenance section 36 via a gear set (not shown). With reference to FIG. 14, when the carriage 13 moves by a preset distance (amount) in the direction indicated by arrow D, the bias force of the first bias spring 105*c* moves the block section 105*a* toward the side plate 39*c*. This brings the switching gear 109 into engagement with a feed gear 113, so that driving force is transmitted to the driving shaft 14 of the feeding unit 6 via a gear set (not shown).

Figure 17:
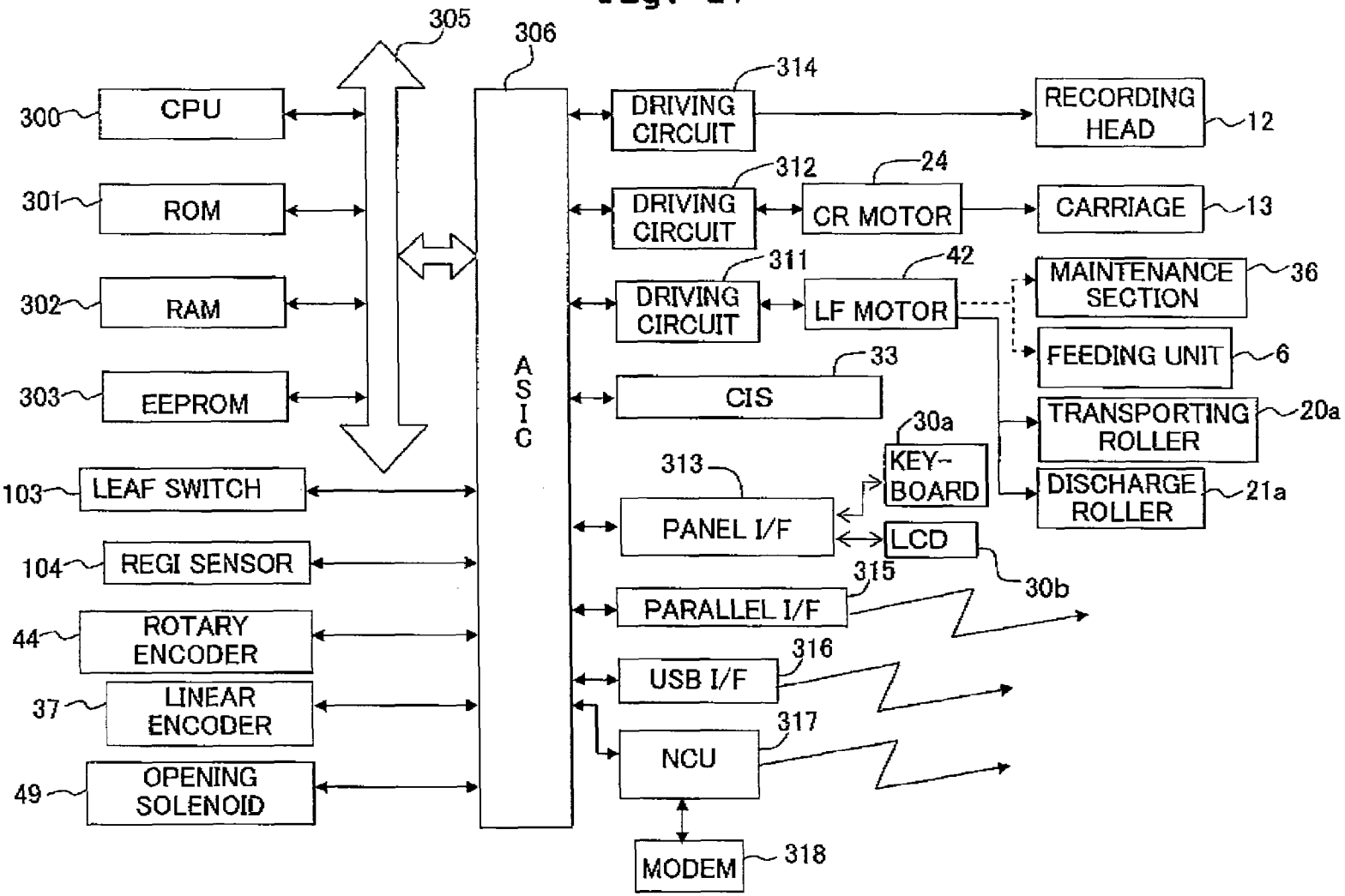
FIG. 17 is a function block diagram of the control unit of the image recording apparatus.

With reference to FIG. 17, the control unit (the control means) of the image recording apparatus 1 will be described below. The control unit controls the overall operation of the image recording apparatus 1.

The control unit is a microcomputer constructed mainly of a CPU 300, a ROM 301, a RAM 302 and an EEPROM 303. The control unit is connected via a bus 305 to an ASIC (an application specific integrated circuit).

The ROM 301 stores the programs which control operations of the ink jet printer. The RAM 302 is used as a storage area, which temporarily stores the data used when the CPU 300 executes the programs, or as a work area.

The ASIC 306 is connected to an NCU (Network Control Unit) 317. The communication signals inputted from the public circuit via the NCU 317 are demodulated by a modem 318 and then inputted to the ASIC 306. When the ASIC 306 transmits image data to the outside by fax transmission or the like, the modem 318 modulates the data into communication signals, which are then outputted to the public circuit via the NCU 317.

In accordance with the commands from the CPU 300, the ASIC 306 generates signals such as phase exciting signals for supplying current to the LF motor 42. The signals are supplied by the ASIC 306 to the driving circuits 311 and 312 for the LF motor 42 and CR motor 24, respectively. The ASIC 306 supplies driving signals via the driving circuits 311 and 312, etc. to the motors 42 and 24 and controls the rotation, stopping, etc. of the motors 42 and 24.

The ASIC 306 is also connected to the scanner 33 (such as a CIS), a panel interface 313, a parallel interface 315, a USB interface 316, etc. The scanner 33 reads the image and/or letters on a paper (document). The panel interface 313 is provided with the keyboard 30*a* and liquid crystal display (LCD) 30*b* of the operation panel 30 for transmitting and receiving operations. Data can be transmitted to and received from a personal computer or another external device via the parallel interface 315 and USB interface 316 through a parallel cable and a USB cable, respectively.

The ASIC 306 is further connected to a leaf switch 103, a registration sensor 104, the rotary encoder 44, the linear encoder 37, etc. The leaf switch 103 is used to detect the turning position of the cam (not shown) of the maintenance section 36. The registration sensor 104 is provided in relation to a sheet end detector 106, which is disposed on the downstream side of the U-turn transporting passage 9 in the forward transporting direction. When a sheet of paper P is fed through the transporting passage 9 to approach a position below the recording head 12, the sheet end detector 106 detects the position of the leading end of the sheet. The rotary encoder 44 detects the amount of rotation of the transporting roller 20*a*. The linear encoder 37 detects the amount of movement of the carriage 13.

A driving circuit 314 causes the recording head 12 to selectively eject ink onto a sheet of paper P at preset timing. The driving circuit 314 controls the driving of the recording head 12 in response to the signals generated in and outputted from the ASIC 306 according to the driving control procedure outputted from the CPU 300. Further, the opening solenoid 49 is connected to the ASIC 306.

Figure 18:
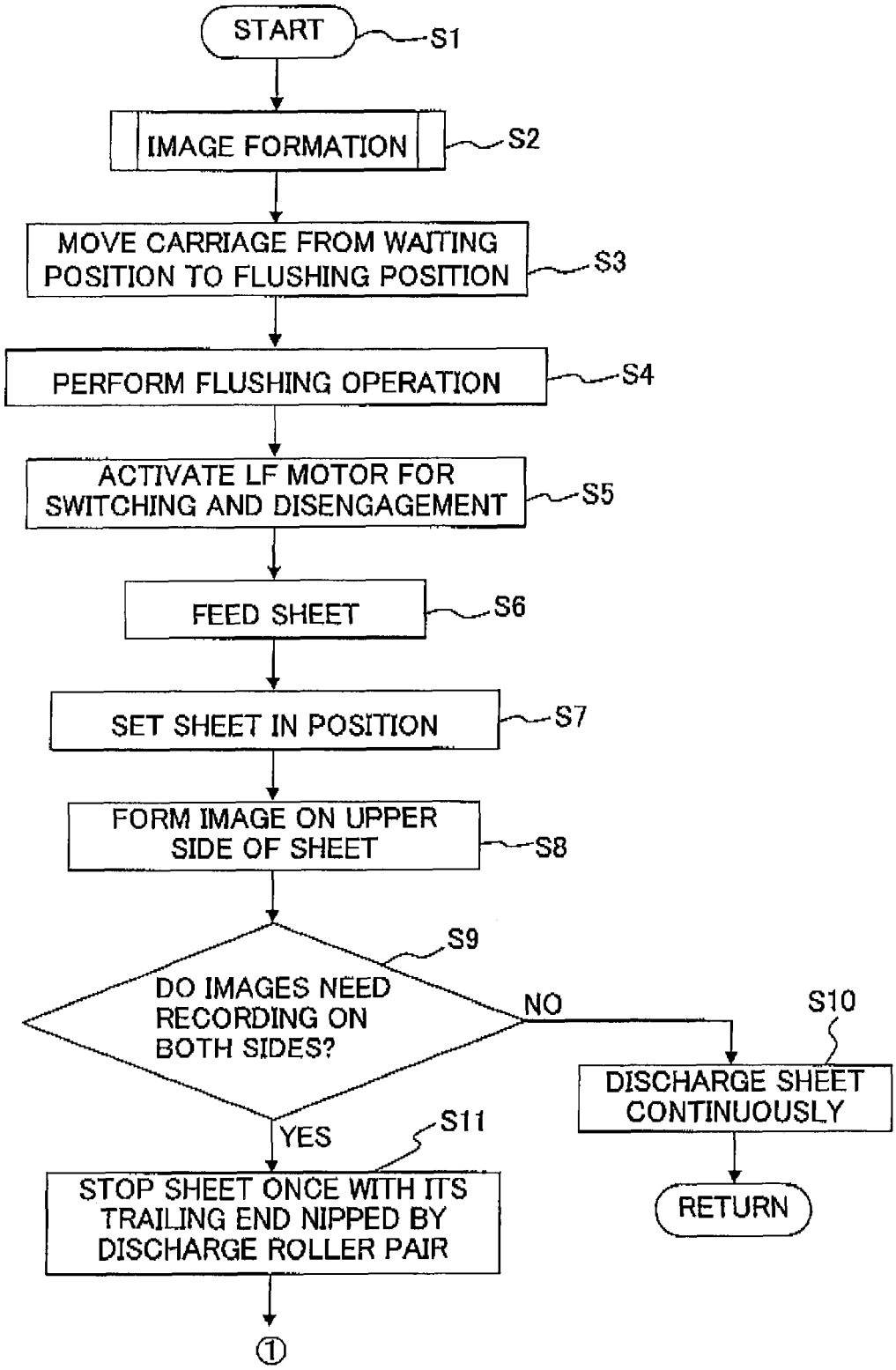
FIGS. 18 and 19 are a flowchart of the double-sided image recording control performed by the control unit.
Figure 19:
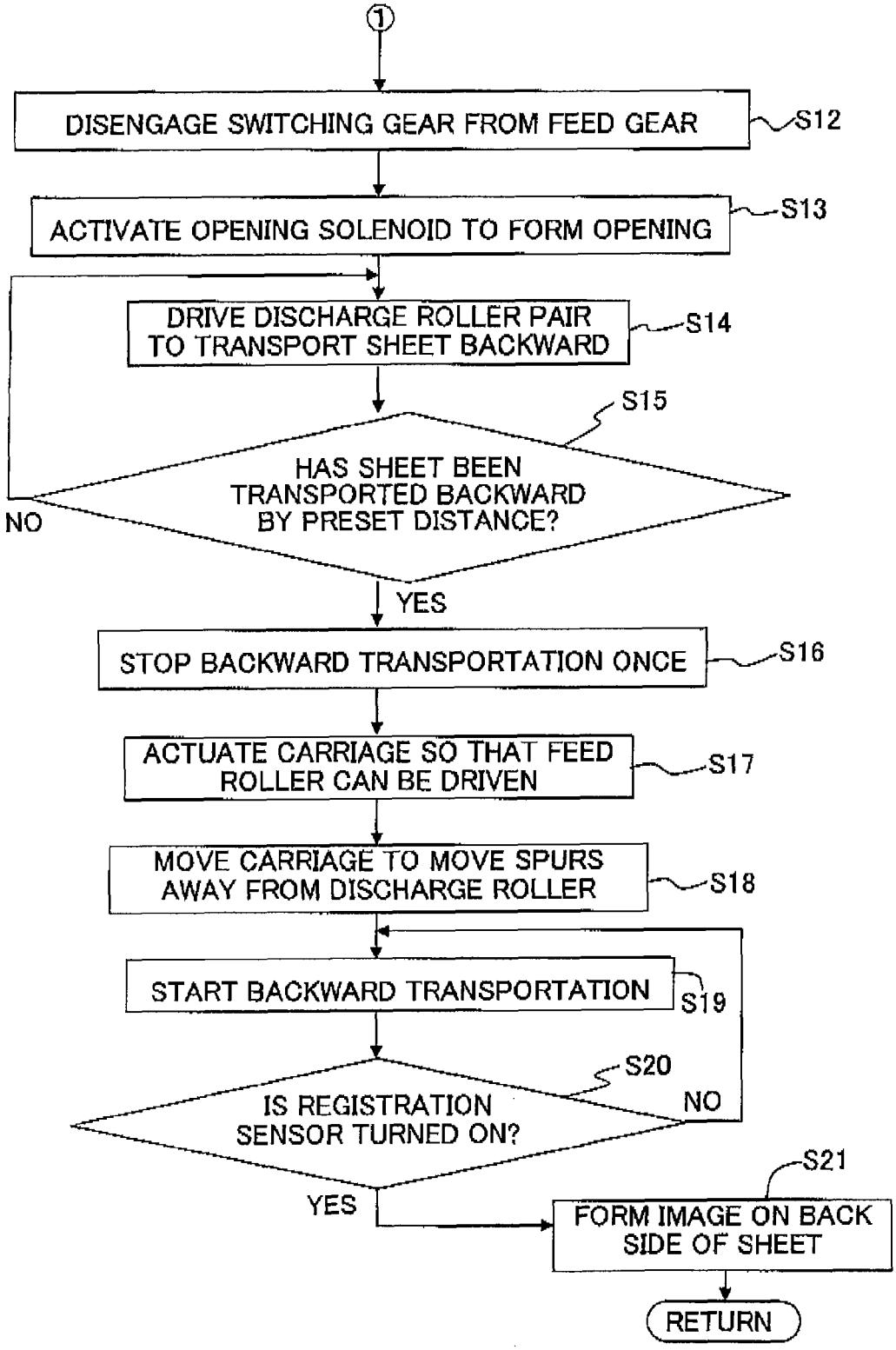

With reference to the flowchart of FIGS. 18 and 19, an explanation will be given below about how the control unit controls the single-sided image recording and the subsequent double-sided image recording. When the image recording apparatus 1 is not switched ON, the carriage 13 is stopped in its waiting condition over the maintenance section 36. The nozzles of the recording head 12 in the carriage 13 in this condition are covered closely with the cap 36*a* on the upper surface of the maintenance section 36.

When the image recording apparatus 1 is switched ON, the control is started (step S1). Thereafter, if an image recording command is received from an external computer (not shown) or another device (step S2), the LF motor 42 rotates by a preset number of steps to lower the cap 36*a* away from the carriage 13 in the waiting position (the initial position).

Subsequently, the CR motor 24 is rotated in the normal direction to move the carriage 13 to a position above the ink reservoir 35 (the flushing position) at the left end in FIG. 3 (step S3). Then, the ink is discharged into the ink reservoir 35 (step S4).

In order to disengage the switching gear 109 of the transmission switching mechanism 100 from the maintenance gear 112, to shift this mechanism 100 laterally smoothly and to engage the switching gear 109 with the feed gear 113 when the carriage 13 leaves the maintenance section 36 in the step S3, the LF motor 42 once rotates reversely by a phase smaller than one pitch of its gear teeth, then rotates in the normal direction to return to its original position (phase) and repeats the reverse rotation and the normal rotation once or twice (step S5).

Subsequently, when the switching gear 109 is in mesh with the feed gear 113, as shown in FIG. 14, sheets of paper P can be fed from the feed cassette 5. With the switching gear 109 in mesh with the feed gear 113, the reverse rotation of the LF motor 42 lowers the arm 6*a* and rotates the feed roller 7 in the feeding direction (clockwise in FIG. 7A) to feed a sheet of paper P (step S6).

When the LF motor 42 rotates reversely, the transporting roller 20*a* of the resist roller pair 20 rotates reversely without transporting sheets of paper P to below the recording head 12. When the LF motor 42 rotates reversely, the teed roller 7 separates the uppermost sheet of paper P in the feed cassette 5, at the lower (first) contact point 7*a* of the feed roller 7. The LF motor 42 keeps rotating reversely by a preset number of steps after the leading end of the sheet passes the sheet end detector 106 (after this sheet end is sensed by the registration sensor 104), which is disposed on the downstream side in the forward transporting direction of the U-turn transporting passage 9 (FIGS. 8A to 8C), and until this sheet end comes into contact with the resist roller pair 20. Subsequently, the LF motor 42 is rotated in the normal direction by a suitable number of steps to perform a setting operation for the sheet P (step S7). The setting operation is an operation in which, after the leading end of the sheet P nipped by the resist roller pair 20 passes the sheet end detector 106, the sheet moves forward to a preset position under the recording head 12 to be set in this position at which an image can start to be recorded on the sheet.

Subsequently, while the sheet P is fed (advanced) intermittently, and while the carriage 13 is reciprocating in the primary scanning direction, the recording head 12 ejects ink through its nozzles to record an image on a side (upper surface) of the sheet (step S8). During the sheet setting and the image recording, the driving shaft 14 rotates reversely, causing the arm 6*a* to pivot upward and rotating the feed roller 7 reversely (clockwise in FIG. 8A).

After the image has been recorded on the upper surface of the sheet P, it is determined whether or not an image needs to be recorded on the lower surface (under side) of the sheet (whether or not the double-sided recording needs to be performed) (step S9). If no image needs to be recorded on the lower surface ("NO" in step S9), the LF motor 42 rotates continuously in the normal direction to discharge the sheet P toward the discharge section 22 (in the direction indicated by arrow B in FIG. 8A) (step S10). Thus, for sequential single-sided image recording on sheets of paper P, the steps S6 to S10 are repeated.

If an image needs to be recorded on the lower surface of the sheet P ("YES" in step S9), the LF motor 42 rotates continuously in the normal direction by a preset amount to transport the sheet until the trailing end (upstream portion in the forward transporting direction) of the sheet P is transported to a position to be nipped between the discharge roller pair 21. Then, the LF motor 42 is stopped once without discharging the sheet P out of the image recording apparatus 1 (step S11).

Subsequently, in order to keep the torque of the LF motor 42 from being transmitted to the feed roller 7 (to keep the feed roller 7 from rotating), the carriage 13 moves laterally by a preset distance in the direction indicated by the arrow C (FIG. 11) within the maintenance section 36 to disengage the switching gear 109 from the feed gear 113 (step S12).

Subsequently, the opening solenoid 49 is activated ON, causing the auxiliary supporting member 46 to pivot upward so that the opening 50 is formed (step S13). Subsequently, with the auxiliary supporting member 46 kept in the raised position, the LF motor 42 is rotated in the normal direction to rotate the discharge roller pair 21 reversely, so that the sheet P is transported backward into the opening 50 (step S14). When the sheet P is transported backward, its rear end (its upstream end in the forward transporting direction) is its leading end. With reference to FIG. 8B, while the sheet P is transported backward, the arm 6*a* is kept in a raised position, so that the feed roller 7 is out of contact with the uppermost sheet of paper P in the feed cassette 5 and spaced from the driven rotor 52.

Subsequently, it is determined whether or not the sheet P has been transported backward by a preset distance until the leading end in the backward transportation of the sheet has moved slightly away from the position between the feed roller 7 and driven rotor 52 (step S15). This preset distance can be detected by the rotary encoder 44. If the sheet P has been transported backward by the preset distance ("YES" at step S15), the backward transportation is stopped once (step S16). Subsequently, the carriage 13 is moved in the direction of arrow D (FIG. 14) to bring the switching gear 109 into mesh with the feed gear 113, enabling the feed roller 7 to be driven (step S17). Then, with reference to FIG. 8C, the motor is rotated in the normal direction to nip the leading end of the sheet P between the feed roller 7 and driven rotor 52. When the sheet end is nipped between the feed roller 7 and driven rotor 52, the feed roller 7 is in contact with the sheet, at an upper (second) contact point 7*b* of the feed roller 7.

Subsequently, with the switching gear 109 in mesh with the feed gear 113, the carriage 13 is shifted in the maintenance section 36 further in the direction of arrow D (step S18). When the carriage 13 is shifted in the direction of arrow D, as shown in FIG. 13, its back end surface 13*a* pushes the contact lever 59 in the direction of arrow E (FIG. 10B) to turn the operating shaft 56 counterclockwise in FIG. 10B. As a result, the lifters 58 lift the contactors 55, so that the spur holder 53 pivots upward (clockwise in FIG. 10B) against the bias force of the coil spring 54, lifting all of the spurs 21*b* away from the discharge roller 21*a* (see the state indicated in FIG. 10B).

Subsequently, the LF motor 42 is rotated continuously in the normal direction to transport the leading end of the sheet P, after the image has been recorded on its one side, upside down to the U-turn transporting passage 9 (step 519). When the sheet P is transported upside down by a preset amount, the registration sensor 104 is activated ON ("YES" in step S20). Subsequently, an image is recorded on the back surface (blank surface) of the sheet P (step S21). The recording on the back surface is identical with the steps S7 and S8 and, accordingly, will not be described in detail.

Thus, images can be recorded (printed) on both sides of a sheet of paper P by the image recording apparatus 1, which is simple in structure and has a small number of parts.

Figure 15A:
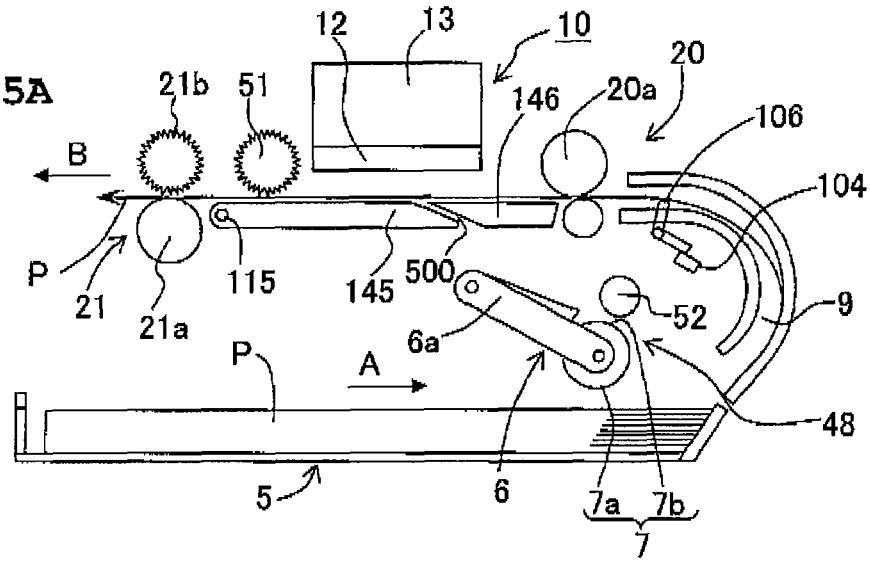
FIGS. 15A to 15C are sectional views showing the operation of a second embodiment of the present invention.
Figure 15B:
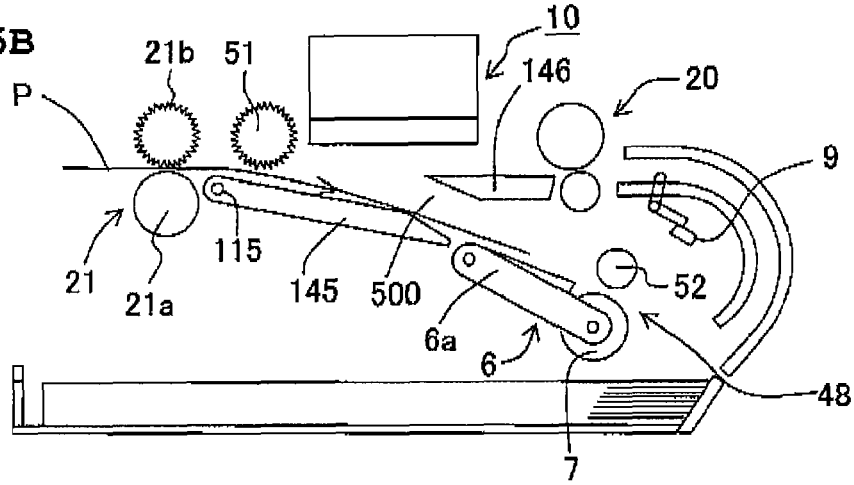
Figure 15C:
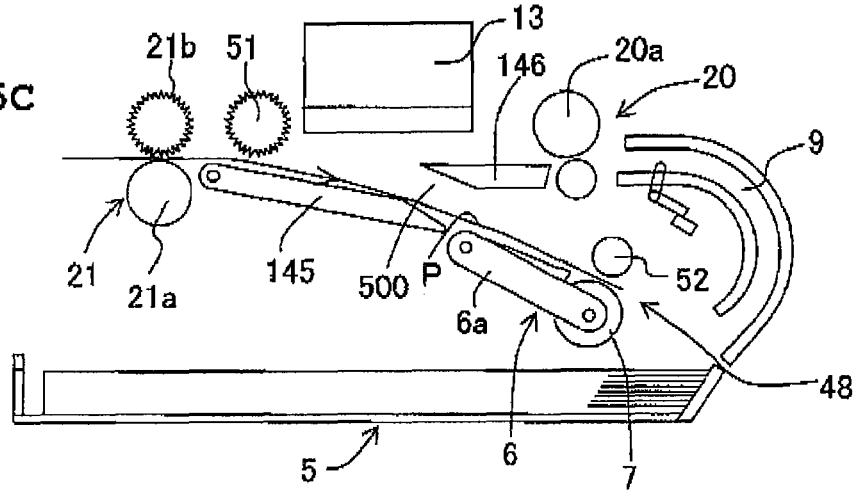

FIG. 15 shows a second embodiment of the present invention. In this embodiment, an auxiliary supporting member 146 is horizontal and fixed, and a main supporting member 145 can pivot on a horizontal shaft 115 so that its free edge, which is upstream in the forward transporting direction, can move downward. When the main supporting member 145 pivots by a preset angle to a lower position and is kept there, a sheet of paper P with an image recorded on its upper surface can be led between the supporting members 145 and 146 onto the arm 6*a*, which is a part of the reverse-transporting mechanism 48. The main supporting member 145 pivots up and down by an electromagnetic solenoid or another actuator (not shown). Otherwise, this embodiment is identical in structure with the first embodiment. The structures and parts of this embodiment which are identical with the counterparts in the first embodiment will be assigned the same reference numerals as the counterparts are assigned, and will not be described in detail. FIGS. 15A to 15C are similar to FIGS. 8A to 8C, respectively, which show the first embodiment. Accordingly, the operation and effects of the second embodiment are substantially identical with those of the first embodiment. In this embodiment as well, when the feed roller 7 feeds a sheet of paper P from the feed cassette 5, this roller 7 rotates in the normal direction with its lower (first) contact point in contact with the sheet to feed the sheet to the transporting passage 9. For double-sided printing in this embodiment, the feed roller 7 rotates reversely with its upper (second) contact point 7*b* in contact with a sheet of paper P with an image recorded on one side of the sheet and cooperates with the driven rotor 52 to feed the sheet to the transporting passage 9.

Figure 16A:
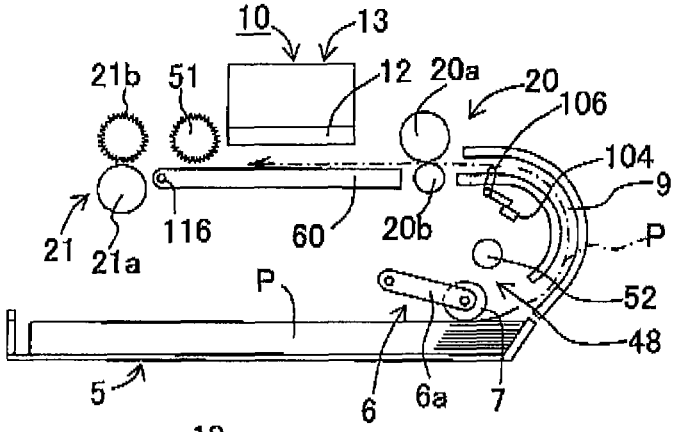
FIGS. 16A to 16D are sectional views showing the operation of a third embodiment of the present invention.
Figure 16B:
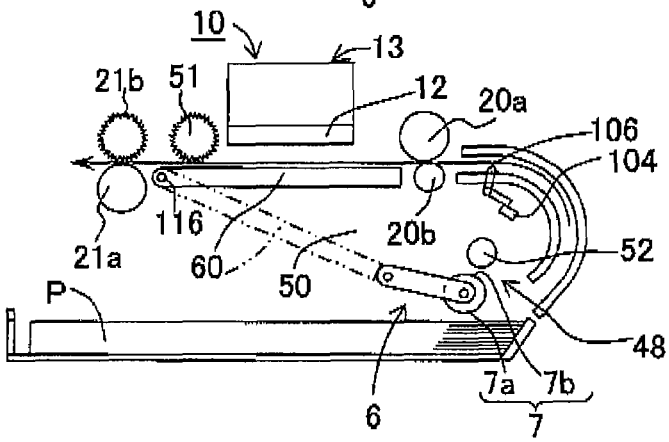
Figure 16C:
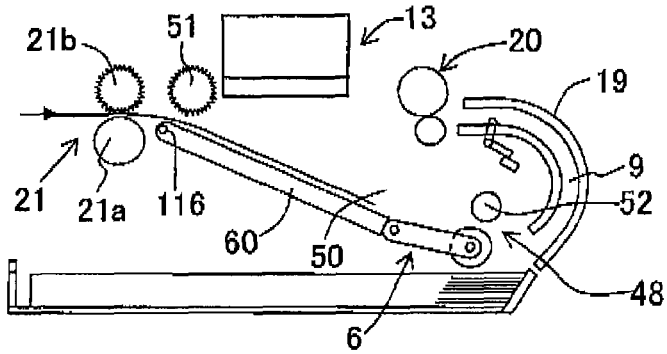
Figure 16D:
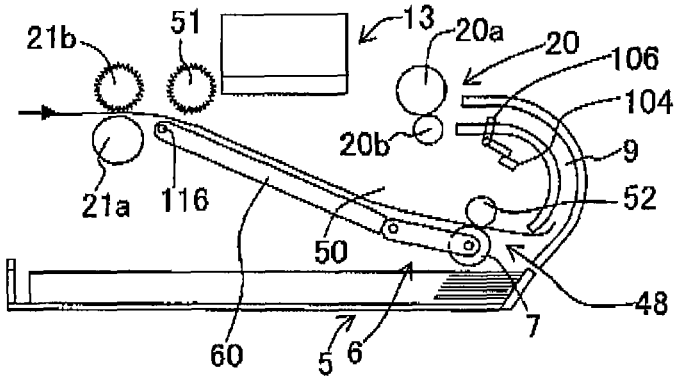

FIGS. 16A to 16D show a third embodiment of the present invention, in which the paper support section 11 is constructed of one supporting member 60. The supporting member 60 is supported pivotably on a horizontal shaft 116 so that the free edge of this member, which is upstream in the forward transporting direction, can shift downward. When the supporting member 60 pivots by a preset angle to a lower position and is kept there, a large opening 50 is formed below the carriage 13. A sheet of paper P with an image recorded on its upper surface can be led through the opening 50 onto the arm 6*a*, which is a part of the reverse-transporting mechanism 48. The supporting member 60 pivots up and down by an electromagnetic solenoid or another actuator (not shown). Otherwise, this embodiment is identical in structure with the first embodiment. The structures and parts of this embodiment which are identical with the counterparts in the first embodiment will be assigned the same reference numerals as the counterparts are assigned, and will not be described in detail. FIG. 16A shows how the uppermost sheet of paper P piled in the feed cassette 5 is transported onto the supporting member 60, and how an image can be recorded on the upper surface of the sheet on the supporting member 60 (one-sided recording). FIGS. 16B to 16D are similar to FIGS. 8A to 8C, respectively, which show the first embodiment. Accordingly, the operation and effects of the second embodiment are substantially identical with those of the first embodiment. In this embodiment as well, when the feed roller 7 feeds a sheet of paper P from the feed cassette 5, this roller 7 rotates in the normal direction with its lower (first) contact point in contact with the sheet to feed the sheet to the transporting passage 9. For double-sided printing in this embodiment, the feed roller 7 rotates reversely with its upper (second) contact point 7*b* in contact with a sheet of paper P with an image recorded on one side of the sheet and cooperates with the driven rotor 52 to feed the sheet to the transporting passage 9.

As stated above, in each of the image recording apparatuses embodying the present invention, the reverse-transporting mechanism 48 can lead a sheet of paper P with an image recorded on one side of the sheet to the U-turn transporting passage 9 and transport the led sheet backward again toward the recording head. Accordingly, the reverse-transporting mechanism 48 is very simple in structure and has a small number of parts in comparison with the conventional reverse-transporting mechanism for double-sided image recording. In each of these image recording apparatuses, the feed roller can not only feed sheets of paper to the transporting passage for single-sided recording, but also feed sheets of paper again to the transporting passage for double-sided recording. Accordingly, there is no need to provide the image recording apparatus with a transporting mechanism dedicated to double-sided recording, and it is possible to shorten the transporting passage.

The present invention is not limited to the embodiments described above with reference to the drawings. The embodiments may be modified without departing from the spirit of the invention.

In each of the first and second embodiments, one of the main and auxiliary supporting members pivots (is inclined) so that an opening can be formed. Both of the supporting members may pivot so that an opening can be formed. Alternatively, an opening may be formed even without the supporting members pivoting specifically, as shown in FIG. 15A, a gap 500 is formed between main supporting member 145 and auxiliary supporting member 146. Sheet of paper P can be transported through the gap 500 to the feed roller 7. In particular, the surfaces of the two supporting members 145 and 146 between which the gap 500 is formed are so inclined that a sheet of paper P can move into the gap 500 only when the sheet is transported upstream. Accordingly, by adjusting the timing according to which the discharge roller pair 21 moves sheets of paper P reversely and the position where the gap 500 is formed, it is possible to transport the sheet through the gap 500 (opening) to the feed roller 7 without inclining the main supporting member 145 as sown in FIG. 15B. Accordingly, an opening may be formed permanently (in a fixed manner) through one of the supporting members.

Each of the embodiments is an image recording apparatus provided with an ink jet recording head. However, an image recording apparatus according to the present invention is not limited to the embodiments, but may be provided with a transfer recording head, a wire dot recording head, a laser head or any other recording head. This image recording apparatus may be a printer without faxing, scanning and other functions. The image recording apparatus may be provided with a feeding unit and a reverse-transporting mechanism which have any structures as far as they operate and produce effects within the scope of the invention.

What is claimed is:

1. An image recording apparatus comprising:

a recording head which records an image on a recording medium;

a paper feeding section which feeds the recording medium in a forward transporting direction toward the recording head;

a transporting passage in which the recording medium is transported in the forward transporting direction from the paper feeding section toward the recording head;

a support section which is provided below the recording head and which supports the recording medium being transported, the support section comprising an opening formed therethrough which opens when the recording medium is transported in a backward transporting direction, wherein the opening is formed by moving the support section; and a reverse-transporting mechanism which is provided between the opening and the transporting passage and which is configured to transport, toward the recording head, the recording medium with an image recorded on one side thereof.

2. The image recording apparatus according to claim 1, further comprising a main case; wherein:

the paper feeding section comprises: a feed cassette which is provided below the recording head and is configured to store a plurality of sheets of the recording medium piled substantially horizontally therein; and a feeding unit which is provided over the feed cassette and which feeds the sheets of the recording medium piled in the feed cassette by separating the sheets one by one; and the transporting passage is a U-turn passage in which the recording medium is transported in an upward direction from the feed cassette such that the recording medium faces a bottom surface of the recording head.

3. The image recording apparatus according to claim 2, wherein:

the support section comprises a supporting member which is provided between the recording head and the feed cassette to support the recording medium being transported;

the opening is formed by inclining the supporting member downward so that an edge of the supporting member which is upstream in the forward transporting direction approaches an upper side of the feeding unit; and the recording medium with the image recorded on the one side thereof is transported in the backward transporting direction toward the reverse-transporting mechanism by reversely rotating a pair of discharge rollers arranged on a downstream side of the supporting member in the forward transporting direction.

4. The image recording apparatus according to claim 3, wherein when the image has been recorded on the one side of the recording medium by the recording head and then image-recording is performed for the other side of the recording medium, the supporting member is inclined downward to transport the recording medium in the backward transporting direction after once stopping the recording medium in a state that an upstream end of the recording medium in the forward transporting direction is nipped by the pair of discharge rollers, so that the recording medium is guided to the reverse-transporting mechanism arranged over the feeding unit.

5. The image recording apparatus according to claim 3, wherein when a downstream end in the backward transporting direction of the recording medium nipped by the pair of discharge rollers reaches at a nipping position at which the downstream end is nipped by the feed roller and the driven rotor, the pair of discharge rollers releases the recording medium.

6. The image recording apparatus according to claim 2, wherein the support section comprises a supporting member which is provided between the recording head and the feed cassette to support the recording medium being transported;

the supporting member comprises downstream member and an upstream member, the downstream member being disposed on a downstream side of the upstream member in the forward transporting direction, and at least one of the downstream and upstream members is inclined to form the opening through the supporting member; and the recording medium with the image recorded on the one side thereof is transported in the backward transporting direction toward the reverse-transporting mechanism by reversely rotating a pair of discharge rollers arranged on a downstream side of the downstream member in the forward transporting direction.

7. The image recording apparatus according to claim 6, wherein when the image has been recorded on one side of the recording medium by the recording head and then image-recording is performed for the other side of the recording medium, a part of the supporting member along the forward transporting direction is inclined downward to transport the recording medium in the backward transporting direction after once stopping the recording medium in a state that an upstream end of the recording medium in the forward transporting direction is nipped by the pair of discharge rollers, so that the recording medium is guided to the reverse-transporting mechanism arranged over the feeding unit.

8. The image recording apparatus according to claim 2, wherein:

the feeding unit comprises an arm configured to pivot upward and downward and support at least a portion of the recording medium thereon, and a reversible feed roller supported rotatably by a free end of the arm; and the reverse-transporting mechanism comprises the arm, the feed roller and a driven rotor which is disposed above the feed roller and is configured to come into contact with a cylindrical surface of the feed roller.

9. The image recording apparatus according to claim 2, wherein the recording head is an ink jet recording head which jets ink droplets selectively toward the recording medium on the support section.

10. The image recording apparatus according to claim 1, further comprising a plurality of rollers arranged on a upstream side of the recording head; wherein:

the opening is formed a downstream side of a roller of the plurality of rollers and which is positioned closest to the recording head.

11. The image recording apparatus according to claim 1, wherein the opening is formed by a downward pivot of the support section.

12. An image recording apparatus comprising:

a recording head which records an image on a recording medium;

a paper feeding section including a feed roller which feeds the recording medium in a forward transporting direction to the recording head by making contact with the recording medium;

a transporting passage formed from the paper feeding section toward the recording head;

a pair of discharge rollers which nip the recording medium and which rotates in one direction to discharge the recording medium with an image recorded on one side of the medium by the recording head, and which rotates in a reverse direction to the one direction for double-sided recording on the recording medium;

a driven roller which nips, together with the feed roller, the recording medium transported by the rotation of the pair of discharge rollers in the reverse direction to feed the nipped recording medium to the transporting passage;

a support section which supports the recording medium being transported in the vicinity of the recording head, the support section comprising an opening formed therein, the recording medium with the image recorded on the one side thereof passing through the opening, wherein the opening is formed by moving the support section.

13. The image recording apparatus according to claim 12, wherein:

the feed roller comes into contact with the recording medium at a first contact point of the feed roller when the feed roller feeds the recording medium from the paper feeding section; and the feed roller comes into contact with the recording medium at a second contact point of the feed roller when the feed roller feeds, together with the driven roller, the recording medium to the transporting passage after the image is recorded on the one side of the recording medium.

14. The image recording apparatus according to claim 13, wherein the feed roller rotates in the one direction when feeding the recording medium from the paper feeding section; and the feed roller rotates in the reverse direction to the one direction when the feed roller feeds the recording medium together with the driven roller.

15. The image recording apparatus according to claim 12, wherein the support section comprises a movable part and a fixed part, and the movable part moves relative to the fixed part to form the opening.

16. The image recording apparatus according to claim 12, further comprising a control unit which controls the pair of discharge rollers such that the pair of discharge rollers rotate in the reverse direction when the double-sided recording is performed.

17. The image recording apparatus according to claim 12, further comprising a plurality of rollers arranged on a upstream side of the recording head; wherein:

the opening is formed a downstream side of a roller of the plurality of rollers and which is positioned closest to the recording head.

18. The image recording apparatus according to claim 12, wherein the opening is formed by a downward pivot of the support section.

19. An image recording apparatus comprising:

a recording head which records an image on a recording medium;

a paper feeding section which feeds the recording medium in a forward transporting direction toward the recording head, the paper feeding section comprising:

a feed cassette provided below the recording head and configured to store a plurality of sheets of the recording medium piled substantially horizontally therein, and a feeding unit provided over the feed cassette, which feeds the sheets of the recording medium piled in the feed cassette by separating the sheets one by one, wherein the feeding unit comprises an arm configured to pivot upward and downward and support at least a portion of the recording medium thereon, and a reversible feed roller supported rotatably by a free end of the arm; and a transporting passage in which the recording medium is transported in the forward transporting direction from the paper feeding section toward the recording head.

* * * * *